US010189623B2

(12) United States Patent
Voelker

(10) Patent No.: US 10,189,623 B2
(45) Date of Patent: Jan. 29, 2019

(54) CONTAINER ASSEMBLIES FOR STORING, SHIPPING, AND/OR DISPENSING FLUIDS, AND RELATED METHODS

(75) Inventor: Scott C. Voelker, St. Louis, MO (US)

(73) Assignee: Monsanto Technology LLC, St. Louis, MO (US)

( * ) Notice: Subject to any disclaimer, the term of this patent is extended or adjusted under 35 U.S.C. 154(b) by 256 days.

(21) Appl. No.: 13/580,610

(22) PCT Filed: Feb. 25, 2011

(86) PCT No.: PCT/US2011/026317
§ 371 (c)(1),
(2), (4) Date: Aug. 22, 2012

(87) PCT Pub. No.: WO2011/106698
PCT Pub. Date: Sep. 1, 2011

(65) Prior Publication Data

US 2012/0312813 A1 Dec. 13, 2012

Related U.S. Application Data

(60) Provisional application No. 61/308,779, filed on Feb. 26, 2010.

(51) Int. Cl.
*B65D 77/06* (2006.01)
*B31B 1/26* (2006.01)
(Continued)

(52) U.S. Cl.
CPC ..... *B65D 77/065* (2013.01); *B65D 5/4204* (2013.01); *B65D 5/4608* (2013.01); *B65D 25/2894* (2013.01); *B65D 77/0426* (2013.01)

(58) Field of Classification Search
CPC .. B65D 5/4204; B65D 5/4608; B65D 77/065; B65D 77/0426; B65D 25/2894; B65D 1/20
(Continued)

(56) References Cited

U.S. PATENT DOCUMENTS 1,965,503 A * 7/1934 Lowman ..... B65D 5/0263 206/167
2,780,402 A 2/1957 Heiblim et al.
(Continued)

FOREIGN PATENT DOCUMENTS

CA 138748 2/2012
DE 37 22 691 A1 1/1989
(Continued)

OTHER PUBLICATIONS

Hedwin, Cubitainer® Combination Package,www.hedwin.com, 6 pages, printed Jun. 7, 2010.
(Continued)

*Primary Examiner* — Andrew Perreault
(74) *Attorney, Agent, or Firm* — Erin C. Robert; Harness, Dickey & Pierce, P.L.C.

(57) ABSTRACT

A container assembly includes a container and a receptacle configured to be positioned within the container. The receptacle has an opening for dispensing fluid, and the container has an opening that aligns with the receptacle opening when the receptacle is positioned within the container. The container opening defines an ergonomic cutout portion for use in grasping the container for carrying the container and receptacle together, and for dispensing fluid from the receptacle when the receptacle is positioned within the container. The container can also include window openings for viewing fluid level in the receptacle when positioned within the container, and a knockout configured to be removed from the container to allow access to the receptacle through the container. And, the receptacle can include a handle for grasping in connection with the ergonomic cutout portion for use in carrying the container and receptacle together and dispensing fluid from the receptacle.

4 Claims, 32 Drawing Sheets

(51) Int. Cl.

| | |
|---|---|
| ***B65D 21/02*** | (2006.01) |
| ***B31B 1/74*** | (2006.01) |
| ***B65B 43/10*** | (2006.01) |
| ***B65D 5/72*** | (2006.01) |
| ***B31B 1/90*** | (2006.01) |
| ***B65D 5/42*** | (2006.01) |
| ***B65D 5/468*** | (2006.01) |
| ***B65D 25/28*** | (2006.01) |
| ***B65D 77/04*** | (2006.01) |

(58) Field of Classification Search

USPC ..... 215/395–398; 220/62.2, 83.6, 771, 220/23.87, 23.91, 751; 222/466, 465.1, 222/608; 229/117, 13, 117.24, 109, 229/117.35, 918, 117.13; 206/509

See application file for complete search history.

(56) References Cited

U.S. PATENT DOCUMENTS 3,054,549 A 9/1962 Humphrey
3,066,819 A * 12/1962 Cox ..... B65D 23/10 119/430
3,119,544 A * 1/1964 Cope ..... B65D 5/4608 206/594
3,167,221 A * 1/1965 Feinstein ..... B65D 47/061 222/481
D202,479 S 10/1965 Kelly
D207,243 S 3/1967 Kelly
3,349,986 A * 10/1967 Chapman ..... B65D 5/76 206/588
3,375,715 A 4/1968 Hodges et al.
3,400,846 A 9/1968 Kelly
3,506,167 A * 4/1970 Orr ..... B65D 23/04 215/309
3,765,574 A 10/1973 Urquiza
3,834,594 A * 9/1974 Schiemann ..... B65D 1/20 222/464.1
3,931,916 A 1/1976 Blue et al.
3,957,179 A 5/1976 Bamburg et al.
4,013,168 A 3/1977 Bamburg et al.
D248,831 S 8/1978 Anderson
4,134,531 A 1/1979 Martinez et al.
D252,257 S 7/1979 Dobbs et al.
4,368,827 A * 1/1983 Thompson ..... B29C 49/54 215/398
D270,998 S 10/1983 Stark
4,413,734 A 11/1983 Newcombe, Jr.
D274,223 S 6/1984 Turnbull
4,502,624 A 3/1985 Burrell
D279,078 S 6/1985 Franchi et al.
4,614,298 A 9/1986 Cherry
4,828,929 A 5/1989 Pierson
4,927,042 A 5/1990 Ring
4,932,930 A 6/1990 Coalier et al.
4,969,571 A 11/1990 Bartz
D319,019 S 8/1991 Shanklin et al.
5,074,429 A 12/1991 Konkel et al.
5,114,028 A 5/1992 Ring
D328,168 S 7/1992 Bartle
5,147,271 A 9/1992 Bacques et al.
D334,805 S 4/1993 Ivey
5,301,829 A * 4/1994 Chrisco ..... B65D 21/0228 206/216
5,340,000 A 8/1994 Ring
5,351,849 A 10/1994 Jagenburg et al.
5,353,982 A 10/1994 Perkins et al.
D353,541 S 12/1994 Rogler et al.
5,381,948 A 1/1995 Coalier et al.
5,396,985 A 3/1995 Seki
5,400,955 A 3/1995 Coalier et al.
5,462,169 A 10/1995 Dygert et al.
5,472,124 A 12/1995 Martushev
5,474,203 A 12/1995 Baker
5,497,899 A 3/1996 Wuerfel
D371,967 S 7/1996 Miller
5,584,430 A * 12/1996 Mulry ..... B65D 5/543 229/117.13
D378,494 S 3/1997 Miller
5,628,450 A 5/1997 Cromwell et al.
D387,984 S 12/1997 Magister
5,711,061 A 1/1998 Blake et al.
5,713,469 A 2/1998 Buscema
5,713,509 A 2/1998 Correll
5,715,992 A 2/1998 Andrews et al.
5,749,489 A 5/1998 Benner et al.
D395,004 S 6/1998 Shamoon
5,765,711 A 6/1998 Johnson et al.
5,779,051 A 7/1998 Boutin
D401,147 S 11/1998 Miller
D402,201 S 12/1998 Miller
D402,896 S 12/1998 Conrad
5,909,841 A 6/1999 Andrews et al.
5,954,216 A 9/1999 Meisner et al.
D415,033 S 10/1999 Forecast et al.
5,988,389 A 11/1999 Buscema
6,045,036 A 4/2000 Ring
6,074,331 A 6/2000 Ruggiere, Sr. et al.
D428,341 S 7/2000 Boutin
D434,326 S 11/2000 Smorch
D434,666 S 12/2000 Celaya
6,196,425 B1 * 3/2001 Fielding et al. ..... 222/468
6,196,452 B1 3/2001 Andrews et al.
6,237,840 B1 * 5/2001 Grabowski ..... B65D 5/16 229/117.16
6,290,124 B2 9/2001 Andrews et al.
6,358,191 B1 3/2002 Greever
6,378,733 B1 * 4/2002 Boonzaier ..... B65D 5/103 220/630
6,394,742 B1 5/2002 Buscema
6,588,651 B2 7/2003 Quaintance
6,595,363 B2 7/2003 Peters
D480,972 S 10/2003 Cheresko
6,688,514 B2 2/2004 Evans et al.
D489,939 S 5/2004 Alanson
RE38,631 E 10/2004 Ruggiere, Sr. et al.
D496,865 S 10/2004 Roubal et al.
6,868,982 B2 3/2005 Gordon
D505,076 S 5/2005 Logan
D513,991 S 1/2006 Canino
D516,918 S 3/2006 Leslie et al.
D517,415 S 3/2006 Murphy
D521,870 S 5/2006 Miller et al.
D523,343 S 6/2006 Castner
7,077,309 B2 7/2006 Andrews, Sr.
D527,639 S 9/2006 Voss et al.
D527,647 S 9/2006 Blank
7,137,521 B2 11/2006 Yourist
7,137,533 B1 11/2006 Heath
D538,167 S 3/2007 Jennings et al.
7,249,674 B2 7/2007 Mu et al.
7,275,679 B2 10/2007 Ingalls
D563,234 S 3/2008 Moreno
D573,885 S 7/2008 Considine et al.
D575,637 S 8/2008 Adams
7,520,410 B2 4/2009 Gilbertson et al.
D595,583 S 7/2009 Lovelace et al.
7,708,186 B2 5/2010 Pawlick
D617,635 S 6/2010 Gould
7,726,503 B2 6/2010 Dygert et al.
7,798,391 B2 9/2010 Tibbels et al.
D625,600 S 10/2010 Hill
D628,884 S 12/2010 Smith
D631,358 S 1/2011 Voelker
D640,133 S 6/2011 Jones et al.
7,959,044 B1 * 6/2011 Christian et al. ..... 215/902
8,186,569 B2 * 5/2012 Kelly ..... B65D 5/4608 222/540
D668,144 S 10/2012 Swart et al.
D668,951 S 10/2012 Voelker
D670,170 S 11/2012 Voelker
D671,404 S 11/2012 Thomason
D671,405 S 11/2012 Thomason

(56) References Cited

U.S. PATENT DOCUMENTS

| | | | | |
|---|---|---|---|---|
| D682,679 | S | 5/2013 | Thomason | |
| 8,511,538 | B2 | 8/2013 | Ouillette | |
| D696,131 | S | 12/2013 | Voelker | |
| D703,529 | S | 4/2014 | Voelker | |
| 8,950,657 | B2 * | 2/2015 | Wagner | B65D 5/0227 229/117.11 |
| 2003/0106927 | A1 | 6/2003 | Bryant et al. | |
| 2003/0160092 | A1 | 8/2003 | Philips et al. | |
| 2004/0084457 | A1 | 5/2004 | Bartlett et al. | |
| 2004/0188504 | A1 | 9/2004 | Pierce | |
| 2005/0040216 | A1 | 2/2005 | Quaintance | |
| 2005/0139645 | A1 | 6/2005 | Shean et al. | |
| 2006/0180643 | A1 | 8/2006 | Stephenson | |
| 2007/0051642 | A1 | 3/2007 | Godwin | |
| 2007/0075123 | A1 | 4/2007 | Keefe, Jr. | |
| 2007/0228119 | A1 | 10/2007 | Barner | |
| 2008/0073317 | A1 | 3/2008 | Dygert et al. | |
| 2009/0084706 | A1 | 4/2009 | Keefe, Jr. | |
| 2009/0104324 | A1 | 4/2009 | Bradley | |
| 2010/0001052 | A1 | 1/2010 | Gardner | |
| 2010/0200585 | A1 | 8/2010 | Dygert et al. | |
| 2012/0312813 | A1 | 12/2012 | Voelker | |

FOREIGN PATENT DOCUMENTS

| | | | |
|---|---|---|---|
| EP | 0 169 043 | A2 | 7/1985 |
| EP | 1 060 995 | A2 | 12/2000 |
| WO | WO 2004/011336 | A2 | 2/2004 |
| WO | WO 2005/047169 | A2 | 5/2005 |
| WO | WO 2011/106698 | A1 | 9/2011 |

OTHER PUBLICATIONS

OctaMax, OctaMax Plus & OctaMax Ultra, High-Strength Octagonal Containers and Display Trays "A family of choices", Power Point Presentation, 16 pages received Sep. 30, 2008.

* cited by examiner

CONTAINER ASSEMBLIES FOR STORING, SHIPPING, AND/OR DISPENSING FLUIDS, AND RELATED METHODS

CROSS-REFERENCE TO RELATED APPLICATION

This application is a U.S. national stage filing under 35 U.S.C. § 371 of International Application No. PCT/US2011/026317, which was filed on Feb. 25, 2011, and which published as WO 2011/106698 A1 on Sep. 1, 2011, and which claims the benefit of U.S. Provisional Application No. 61/308,779, filed on Feb. 26, 2010. The entire disclosures of each of the above applications are incorporated herein by reference.

FIELD

The present disclosure generally relates to container assemblies, and more particularly to composite container assemblies having receptacles suitable for holding fluids positioned within containers for use in storing, shipping, and/or dispensing the fluids, and methods related thereto.

BACKGROUND

This section provides background information related to the present disclosure which is not necessarily prior art.

Composite packages having plastic receptacles positioned within paperboard boxes have been used in the food and restaurant industry to package various types of liquids, including cooking oils. In such packages, the receptacles (for receiving the liquids) typically have pouring spouts located toward front walls of the receptacles and elongated handles extending from the pouring spouts to rear walls of the receptacles. And, the paperboard containers typically have single or double layer top assemblies with movable flaps to define first cutout portions for accommodating the receptacle spouts and second cutout portions for accommodating the receptacle handles.

SUMMARY

This section provides a general summary of the disclosure, and is not a comprehensive disclosure of its full scope or all of its features.

Example embodiments of the present disclosure generally relate to container assemblies for storing, shipping, and/or dispensing fluid. In one example embodiment, a container assembly generally includes a first container, and a second container configured to be disposed at least partly within the first container. The second container has an opening for dispensing fluid from the second container, and the first container has an opening aligned with the opening of the second container when the second container is disposed at least partly within the first container. The opening of the first container defines an ergonomic cutout portion for grasping to allow for carrying the first and second containers and to facilitate dispensing of fluid from the second container through the opening of the second container when the second container is disposed at least partly within the first container.

In another example embodiment, a container assembly generally includes a container and a receptacle. The container is formed from corrugated material and has a top portion, a bottom portion, and multiple side portions depending downwardly from the top portion where the top portion is defined by at least three overlapping layers of the corrugated material. The receptacle is configured to be disposed within the container and has an opening for receiving fluid into the receptacle and/or for dispensing fluid from the receptacle. The container also includes an opening defined at least partly in the top portion of the container and at least partly in one of the side portions of the container. The opening of the receptacle is aligned with the opening of the container when the receptacle is disposed within the container, and the opening of the container defines an ergonomic cutout portion for grasping the container and facilitating dispensing of fluid from the receptacle through the opening of the receptacle. The container further includes offset first and second window openings for viewing fluid level in the receptacle when the receptacle is disposed within the container, and reinforcing material disposed adjacent the first and second window openings for enhancing strength of the container. And, the receptacle includes a support portion and a vent structure each in communication with the opening of the receptacle. The support portion is configured to help support the receptacle within the container and thereby help inhibit sliding movement of the receptacle relative to the container when dispensing fluid from the receptacle, and the vent structure is configured to allow air to circulate within the receptacle when dispensing fluid from the receptacle to thereby promote generally uniform flow of the fluid from the receptacle.

In another example embodiment, a container assembly generally includes a container having offset first and second window openings for viewing an interior portion of the container and reinforcing material disposed adjacent the first and second window openings for enhancing strength of the container.

Example embodiments of the present disclosure also generally relate to methods of preparing container assemblies for use in storing, shipping, and/or dispensing fluid. In one example embodiment, a method generally includes folding a single piece blank of material to form a container configured for receiving a receptacle at least partly within the container, wherein a top portion of the folded container includes at least three layers of overlapping material coupled together and an opening defined at least partly in the top portion. The opening defines an ergonomic cutout portion for grasping the container and allowing for carrying the container and receptacle together when the receptacle is disposed at least partly within the container.

Example embodiments of the present disclosure also generally relate blanks of material for use in forming containers suitable for receiving receptacles therein for storing, shipping, and/or dispensing fluid. In one example embodiment, a single piece blank of material generally includes a group of openings defined in the single piece blank of material and positioned to generally align when the single piece blank of material is folded to form the container to thereby define an access opening in a top portion of the formed container. The access opening is aligned with an opening of a receptacle when the receptacle is positioned within the formed container to facilitate dispensing of fluid from the receptacle within the container through the opening of the receptacle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
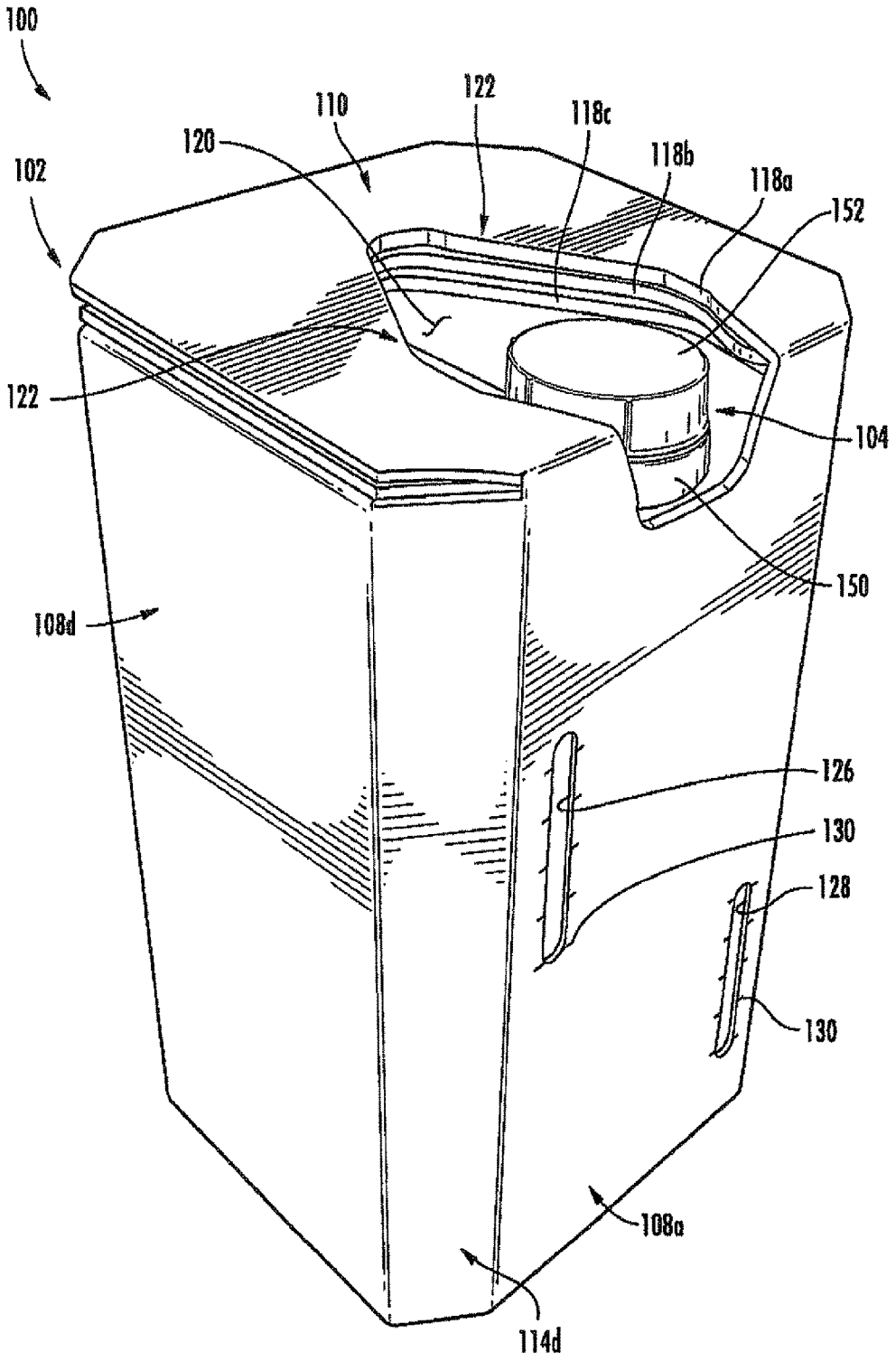
FIG. 1 is a perspective view of an example container assembly including one or more aspects of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. it is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items, Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper", "lower" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference now to the drawings, FIGS. 1-19 illustrate an example container assembly 100 (e.g., a fluid storage and dispensing assembly, etc.) including one or more aspects of the present disclosure. The illustrated container assembly 100 generally includes a composite, semi-rigid bottle-in-box design that promotes easy, safe, and efficient containment, delivery, and/or use of fluids within the container assembly 100. The container assembly 100 can be used, for example, for storing, shipping, and/or dispensing fluids, as desired, where such fluids may include (but are not limited to) chemical fluids such as herbicides, pesticides, fertilizers, etc.

As shown in FIG. 1, the container assembly 100 generally includes a container 102 (e.g., a pack, a box, etc.) (broadly, a first container) and a receptacle 104 (e.g., a bottle, etc.) (broadly, a second container). The receptacle 104 is configured to fit within the container 102 where it can then be filled with desired fluids. The fluids can then be dispensed from the receptacle 104 while disposed within the container 102 without removing the receptacle 104 from the container 102. As such, the container 102 can provide protection (and safety) to the receptacle 104 (and the fluids therein) against, for example, environmental exposure (e.g., rain, heat, etc.), damage from handling, shipping, and/or storing (e.g., falls, drops, etc.), or other damage that may affect the receptacle 104 and/or the fluids therein.

With additional reference to FIGS. 2-7, the container 102 generally includes a box shape having four side portions 108*a*, 108*b*, 108*c*, and 108*d*, an upper (or top) portion 110, and a lower (or bottom) portion 112. Corner portions 114*a*, 114*b*, 114*c*, and 114*d* of the container 102 located generally between adjacent ones of the side portions 108*a*, 108*b*, 108*c*, and 108*d* are beveled giving the container 102 a generally octagonal shape. The beveled corner portions 114*a*, 114*b*, 114*c*, and 114 generally connect adjacent ones of the side portions 108*a*, 108*b*, 108*c*, and 108*d*. The beveled corner portions 114*a*, 114*b*, 114*c*, and 114*d* help optimize storage space within the container 102 (e.g., for receiving the receptacle 104 therein, etc.), and provide improved strength (e.g., compression strength, etc.), structural integrity, and drop impact resistance to the container 102, for example, for protecting the receptacle 104 when the receptacle 104 is disposed within the container 102. The container 102 can be formed from any suitable material within the scope of the present disclosure including, for example, corrugated material, fluted material, cardboard, plastic, composite material, coated material, etc. In addition, the container 102 can be formed from a single blank of material or two or more separate pieces of material within the scope of the present disclosure.

As shown in FIG. 1, the upper portion 110 of the illustrated container 102 includes three individual layers 118*a*, 118*b*, and 118*c* generally defined by overlapping flaps of the container 102. In the illustrated embodiment, the three layers 118*a*, 118*b*, and 118*c* substantially fully overlap and are coupled (e.g., glued, interlocked, fastened, etc.) together to substantially seal the receptacle 104 within the container 102. Each of the individual layers 118*a*, 118*b*, and 118*c* may include a single layer of corrugated material. This construction provides strength and structural integrity to the upper portion 110 of the container 102 (as will be described more hereinafter) and also discourages users from removing the receptacle 104 from the container 102 prior to using the container assembly 100 (e.g., prior to dispensing fluid from the receptacle 104 of the container assembly 100, etc.). In other example embodiments, containers may include upper portions having more than or less then three overlapping layers and/or overlapping layers that do not substantially fully overlap.

An access opening 120 is defined in the illustrated container 102 generally in the upper portion 110 and a forward side portion 108*a* of the container 102. The access opening 120 allows access to the receptacle 104 when the receptacle 104 is disposed within the container 102 (e.g., without requiring manipulating, opening, removing, etc. flaps of the container 102, etc.). More particularly, the access opening 120 provides room for users to fill the receptacle 104 with fluid and/or dispense fluid from the receptacle 104 when the receptacle 104 is disposed within the container 102 without interference from the container 102 (e.g., without contacting the container 102, etc.). The access opening 120 also provides room for users to seal and cap the receptacle 104 after the receptacle 104 is filled and/or open the sealed and capped receptacle 104 in preparation for dispensing fluid. In the illustrated embodiment, the access opening 120 includes a generally diamond shape. In other example embodiments, however, containers may include access openings having other desired shapes, depending on design choices, that provide room for users to access receptacles disposed within the containers. In addition in the illustrated embodiment, the container 102 includes a single access opening.

The access opening 120 also forms, provides, defines, etc. gripping portions 122 in the upper portion 110 of the container 102. The gripping portions 122 may be viewed as ergonomic cutout portions, etc. In the illustrated embodiment, the gripping portions 122 are located toward both sides of the access opening 120. And, the gripping portions 122 are oriented at angles of about thirty degrees. As such, users may grasp the container 102 at the gripping portions 122 with left hands or right hands (e.g., for ergonomic carrying, pouring, etc.) and, for example, lift the container 102 and the receptacle 104 (when the receptacle 104 is disposed within the container 102), move the container 102 and the receptacle 104, and/or manipulate the container 102 to directionally pour fluid from the receptacle 104 (see, FIG. 8). The overlapping construction of upper portion 110 (i.e., the three overlapping layers 118*a*, 118*b*, and 118*c* of the upper portion 110) provides additional strength to the gripping portions 122 of the container 102. This can help inhibit failure of the container 102 at the gripping portions 122 when lifting the container assembly 100 (particularly when the receptacle 104 is filled with fluid), when transporting the container assembly 100, and/or when manipulating the container assembly 100 to pour fluid from the receptacle 104. Additional reinforcement (e.g., reinforcing material, bands, clips, etc.) could be provided to the gripping portions 122 as desired to provide still additional strength thereto.

A security seal (not shown) may be included over the access opening 120 of the container 102 (and over the receptacle 104 disposed within the container 102), as desired. When included, the security seal must be removed in order to access the receptacle 104 within the container 102. As such, the security seal could provide evidence that the container assembly 100 has not been altered or tampered with (e.g., that fluid within the receptacle 104 has not been altered or tampered with, etc.) prior to use. As an example, the security seal may be coupled (e.g., glued, etc.) to the upper portion 110 of the container 102 such that the security seal substantially covers the access opening 120. Perforations may be provided around perimeter edges of the security seal to allow users to easily remove the security seal when desired to access the receptacle 104 (e.g., to pour fluid from the receptacle 104, etc.).

Figure 2:
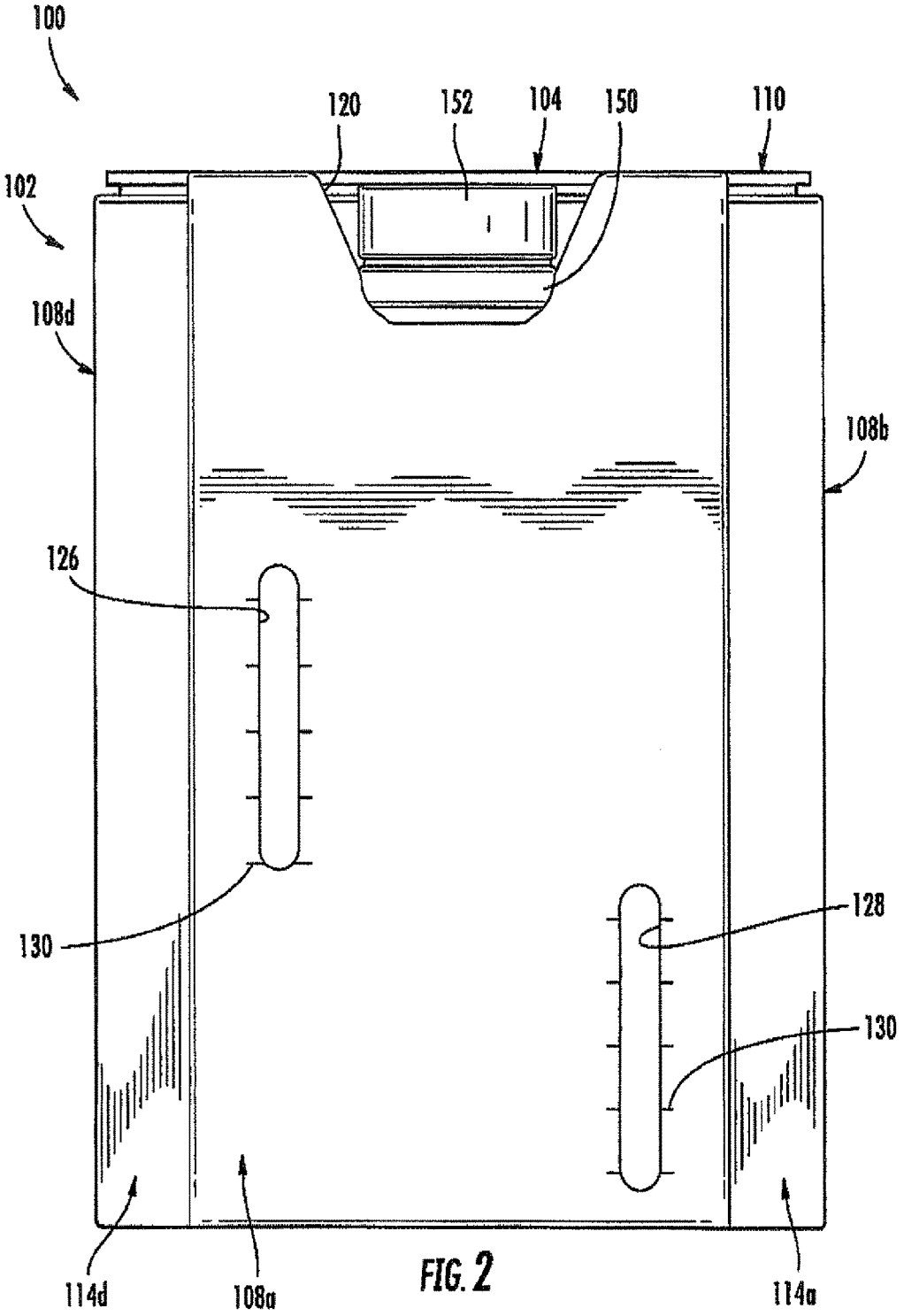
FIG. 2 is a front elevation view of the container assembly of FIG. 1.
Figure 3:
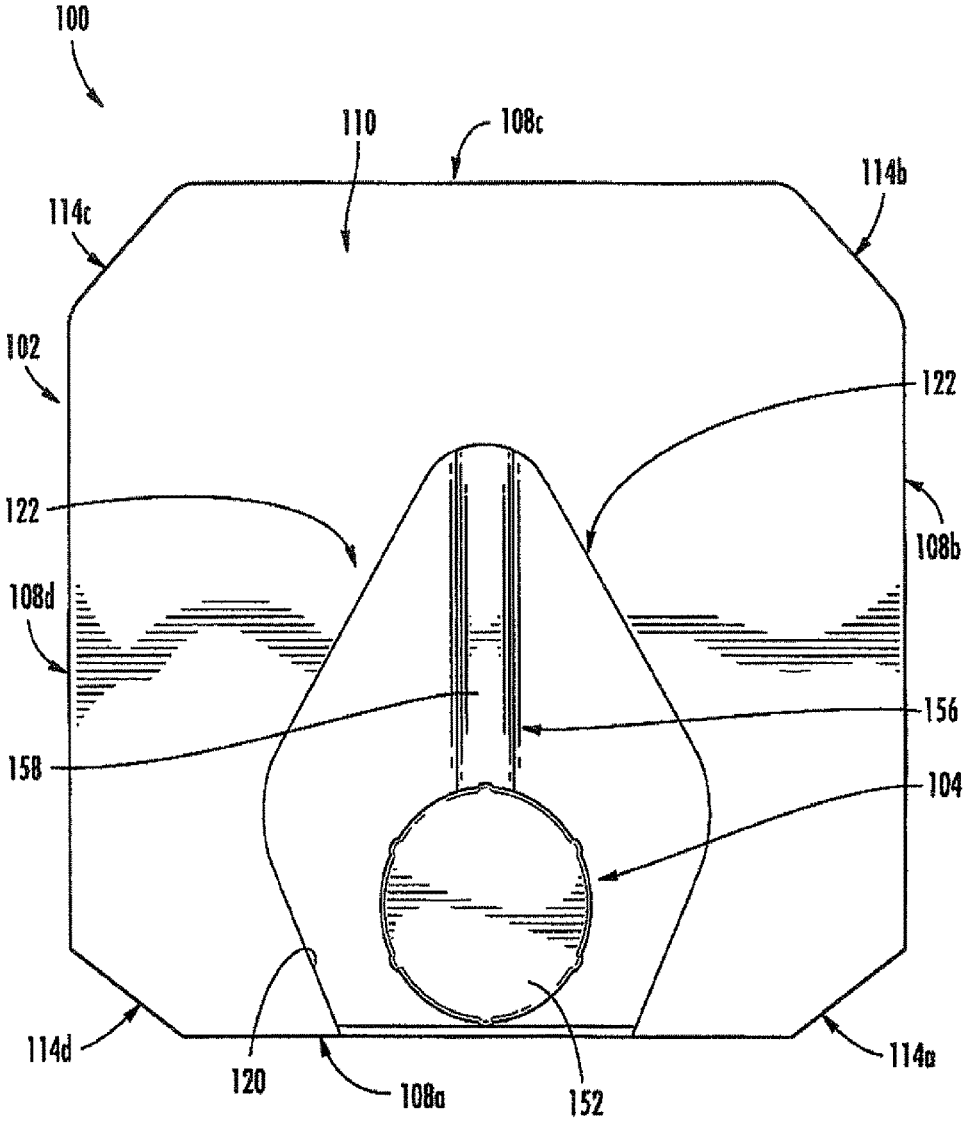
FIG. 3 is a top plan view of the container assembly of FIG. 1.

With continued reference to FIGS. 1 and 2, the container 102 includes first and second window openings 126 and 128 defined in the container's forward side portion 108*a*. The window openings 126 and 128 allow for viewing an interior portion of the container 102, for example, fluid level in the receptacle 104 when the receptacle 104 is disposed within the container 102. The window openings 126 and 128 are generally uniform, narrow, and elongate in shape (e.g., slot shaped, etc.) and have generally rounded end portions. The window openings 126 and 128 extend in a generally vertical direction of the container 102. And, measurement markings 130 (e.g., a scale, etc.) are included generally vertically along the window openings 126 and 128 to help indicate amount of fluid in the receptacle 104. As an example, the measurement markings 130 may include volumetric units (e.g., liters, gallons, etc.) which can be used to indicate volume of fluid in the receptacle 104 and/or to measure volume of fluid dispensed from the receptacle 104.

In the illustrated embodiment, the two window openings 126 and 128 are positioned in a generally offset configuration along the forward side portion 108*a* of the container 102. As viewed in FIG. 2, the first window opening 126 is located toward a left portion of the container's forward side portion 108*a*, and the second window opening 128 is located generally downwardly of the first window opening 126 and toward a right portion of the container's forward side portion 108*a*. And, a lower portion of the first window opening 126 is located generally above an upper portion of the second window opening 128. This spaced apart configuration of the window openings 126 and 128 may help provide strength and stability to the container 102, and may help protect the container 102 against bursting, tearing, etc. under stress (e.g., when the container assembly 100 is dropped with the receptacle 104 filled with fluid, etc.).

Figure 4:
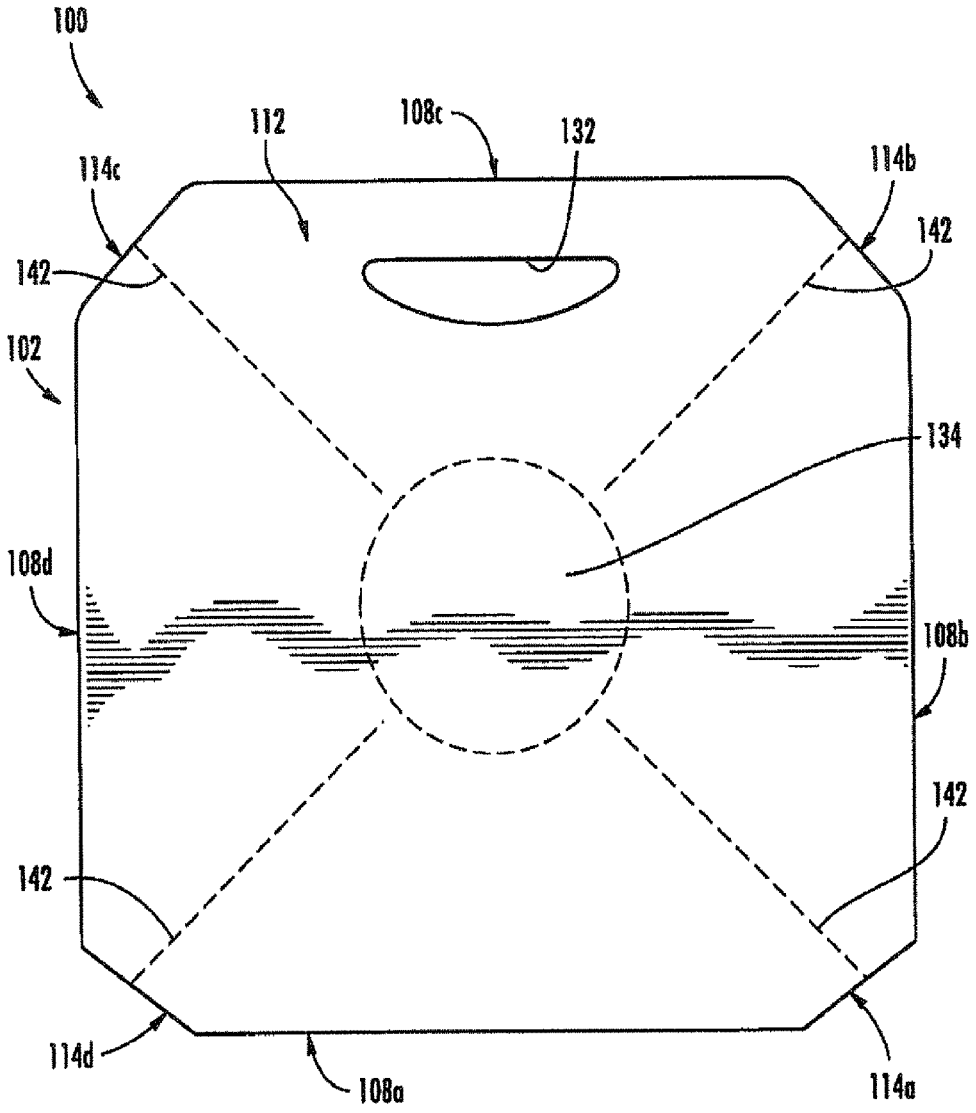
FIG. 4 is a bottom plan view of the container assembly of FIG. 1.
Figure 5:
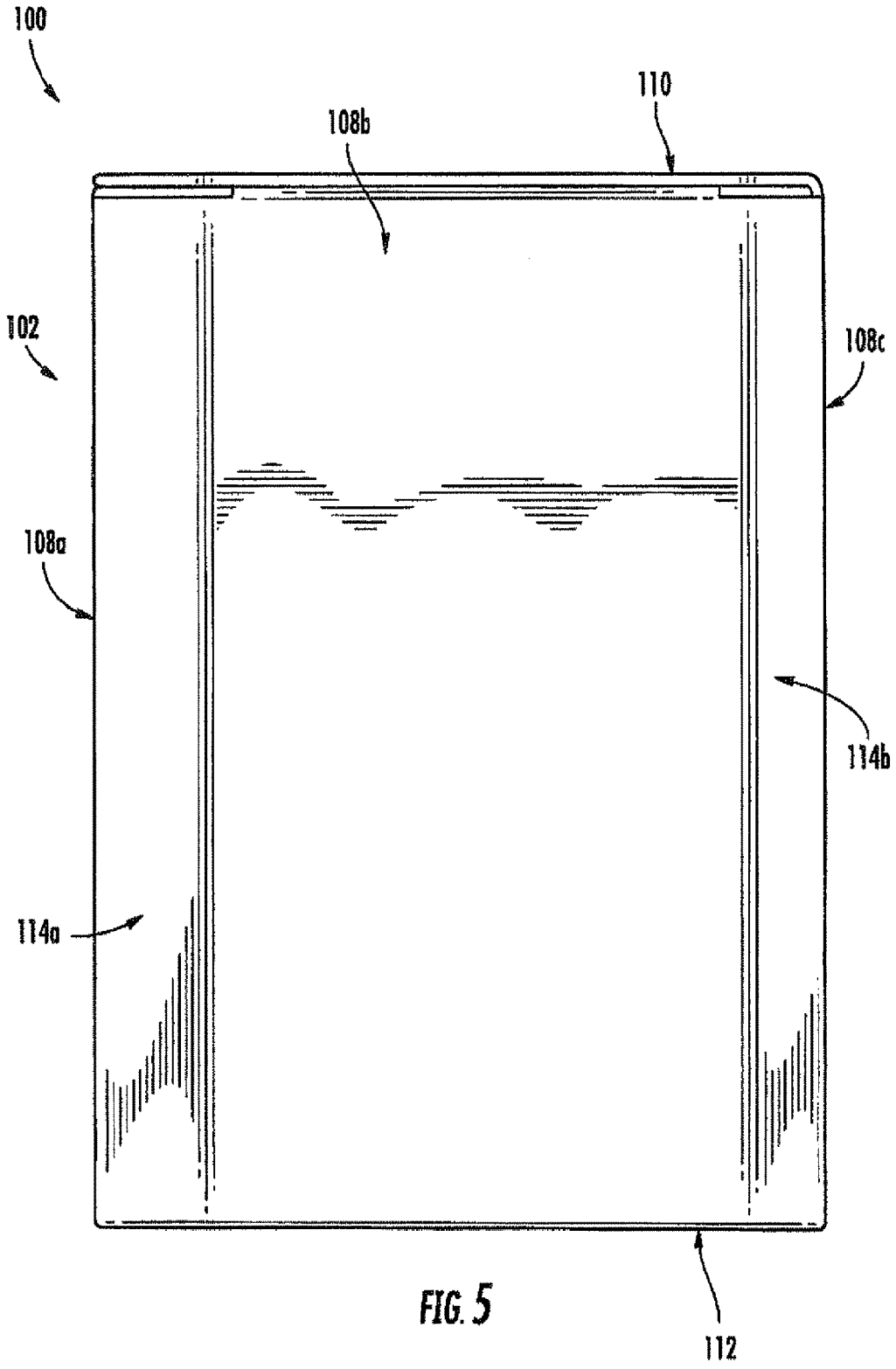
FIG. 5 is a right side elevation view of the container assembly of FIG. 1.
Figure 6:
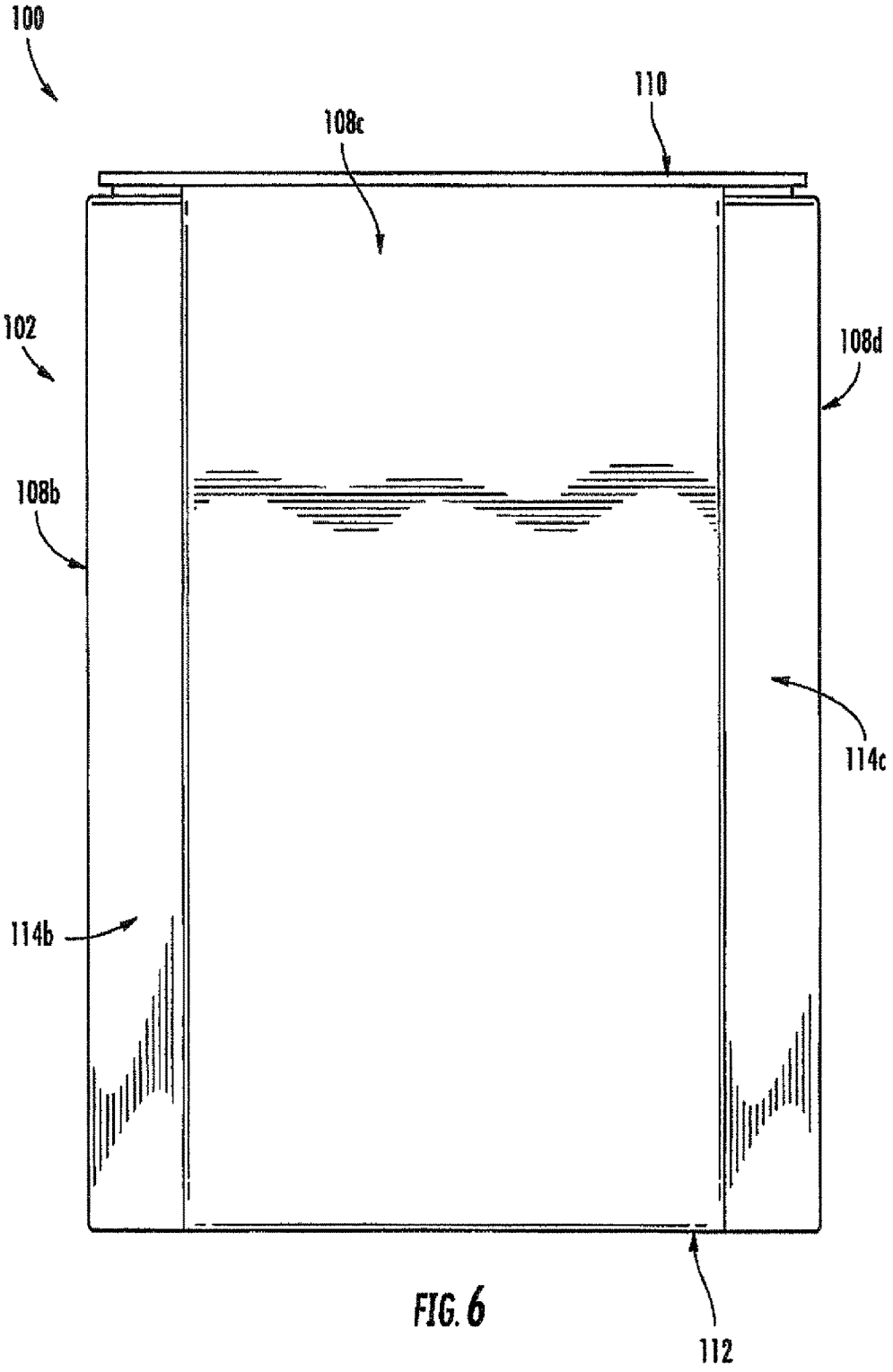
FIG. 6 is a rear elevation view of the container assembly of FIG. 1.
Figure 7:
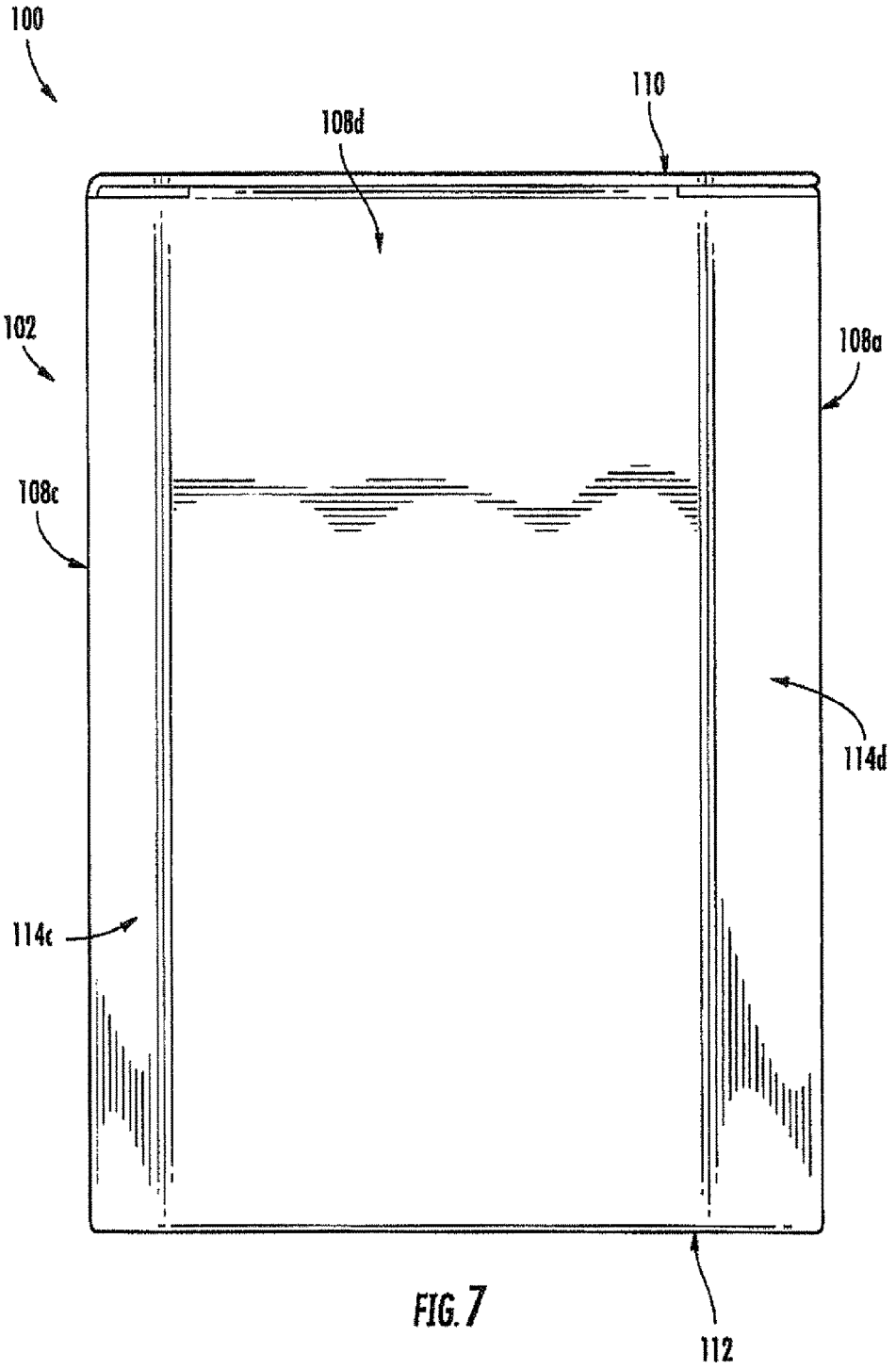
FIG. 7 is a left side elevation view of the container assembly of FIG. 1.
Figure 8:
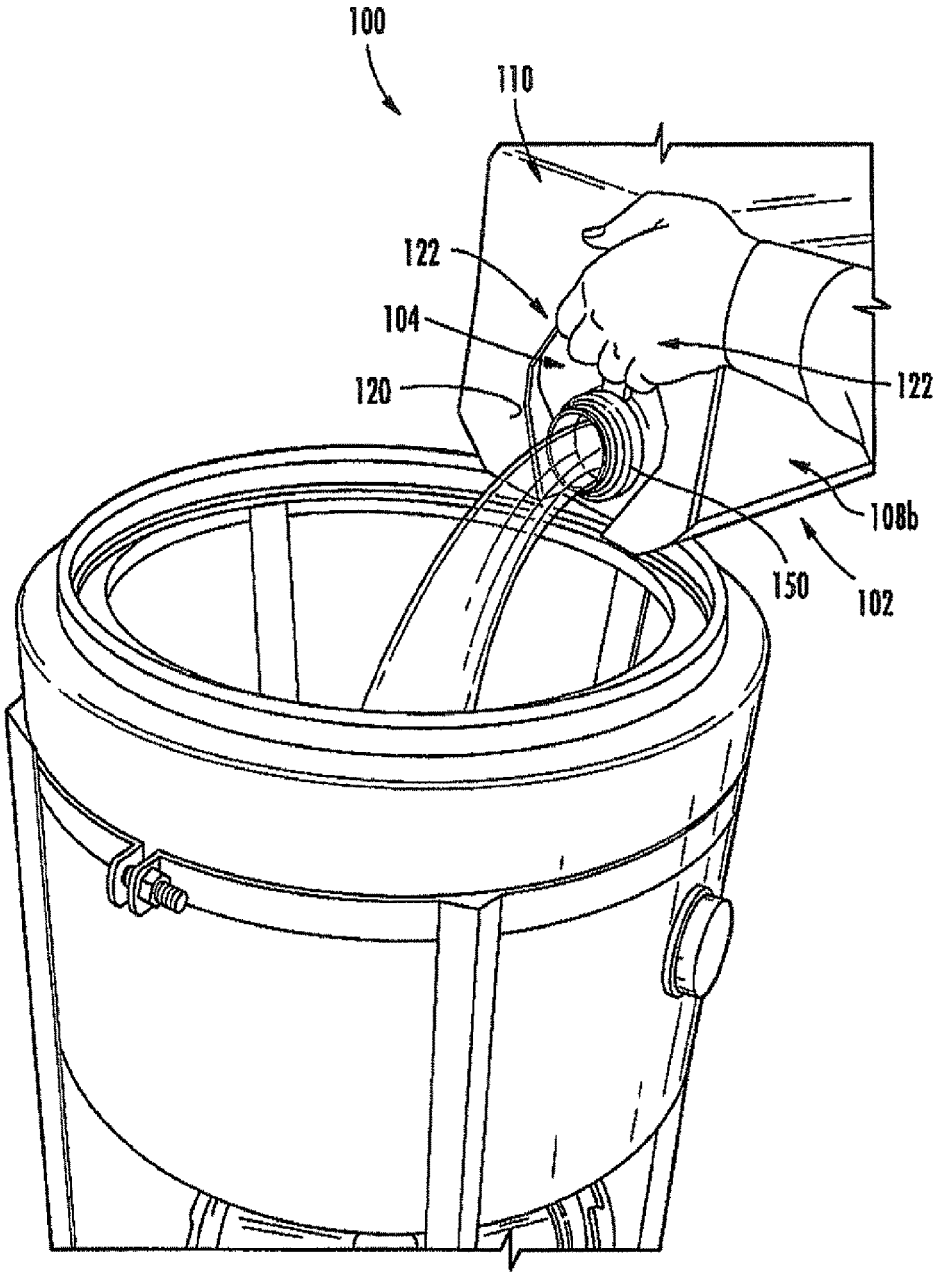
FIG. 8 is a perspective view of the container assembly of FIG. 1 with fluid shown pouring from a receptacle of the container assembly.
Figure 9:
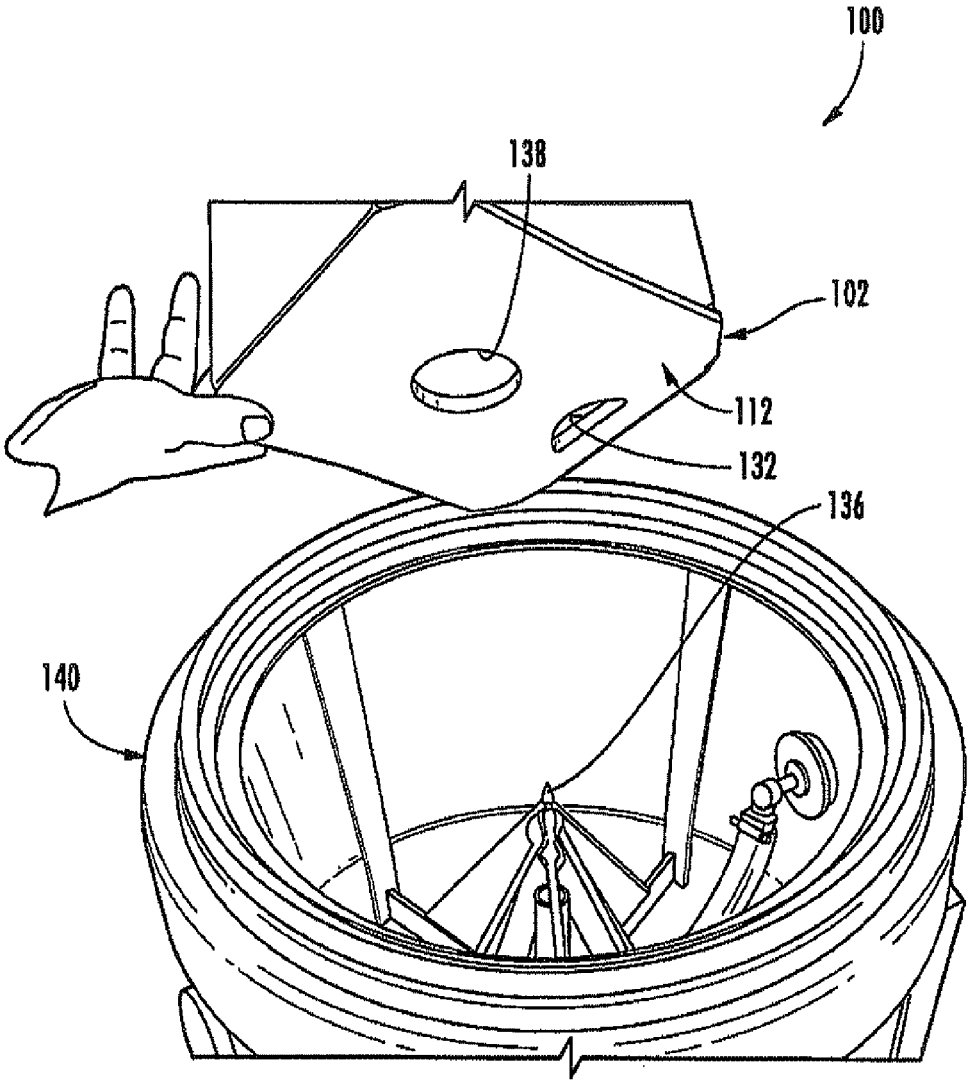
FIG. 9 is a perspective view of the container assembly of FIG. 1 with a knockout removed from a lower portion of a container of the container assembly in preparation for piercing the receptacle within the container through an opening left by the removed knockout.

As shown in FIG. 4, the container 102 also includes an opening 132 and a knockout 134 located in the lower portion 112 of the container 102. The opening 132 is configured for a user to grasp (in combination with the gripping portions 122) when manipulating the container 102 to pour fluid from the receptacle 104. The knockout 134 may be used, for example, in operations where dispensing fluid from the receptacle 104 and/or rinsing the receptacle 104 (when the receptacle 104 is disposed within the container 102) includes piercing a lower portion 112 of the receptacle 104 (without opening the receptacle 104 and/or removing the receptacle 104 from the container 102) (see, FIG. 9). In these operations, the knockout 134 can be removed from the lower portion 112 of the container 102, and the receptacle 104 can then be impaled on a spike 136 through an opening 138 left by the removed knockout 134 (see, FIG. 9). Fluid within the receptacle 104 can then be dispensed, for example, into a tub 140 as shown in FIG. 9. In addition (or alternatively), fluid can be introduced into the receptacle 104 for rinsing the receptacle 104, as desired, through the opening 138 left by the removed knockout 134 and through an opening formed in the pierced receptacle 104 by the spike 136.

In the illustrated embodiment, the knockout 134 has a generally circular shape with a diameter dimension of about 3 inches (about 7.62 centimeters). However, knockouts may have shapes other than circular (e.g., square shapes, oval shapes, etc.) and/or knockouts having dimensions other than about 3 inches (about 7.62 centimeters), depending on design choice, within the scope of the present disclosure. In addition, perforations (indicated by dashed lines in FIG. 4 generally defining the knockout 134) are formed in the lower portion 112 of the container 102 around a periphery of the knockout 134 for allowing the knockout 134 to be easily removed from the lower portion 112, as desired, to allow access to the receptacle 104 within the container 102 through the lower portion 112 of the container 102 (i.e., through the opening 138 left by the removed knockout 134 (see, FIG. 9)).

The lower portion 112 of the container 102 also includes indicia lines 142 for directing users how to remove the receptacle 104 from the container 102 after the container assembly 100 is used. The indicia lines 142 indicate locations to cut the lower portion 112 of the container 102 to open the container 102 for removing the receptacle 104. In other example embodiments, containers may include removable structures such as pull cords, zip cords, etc. disposed within the containers (e.g., within lower surfaces of the containers, etc.) for use in opening the containers and removing receptacles from the containers as desired.

Figure 10:
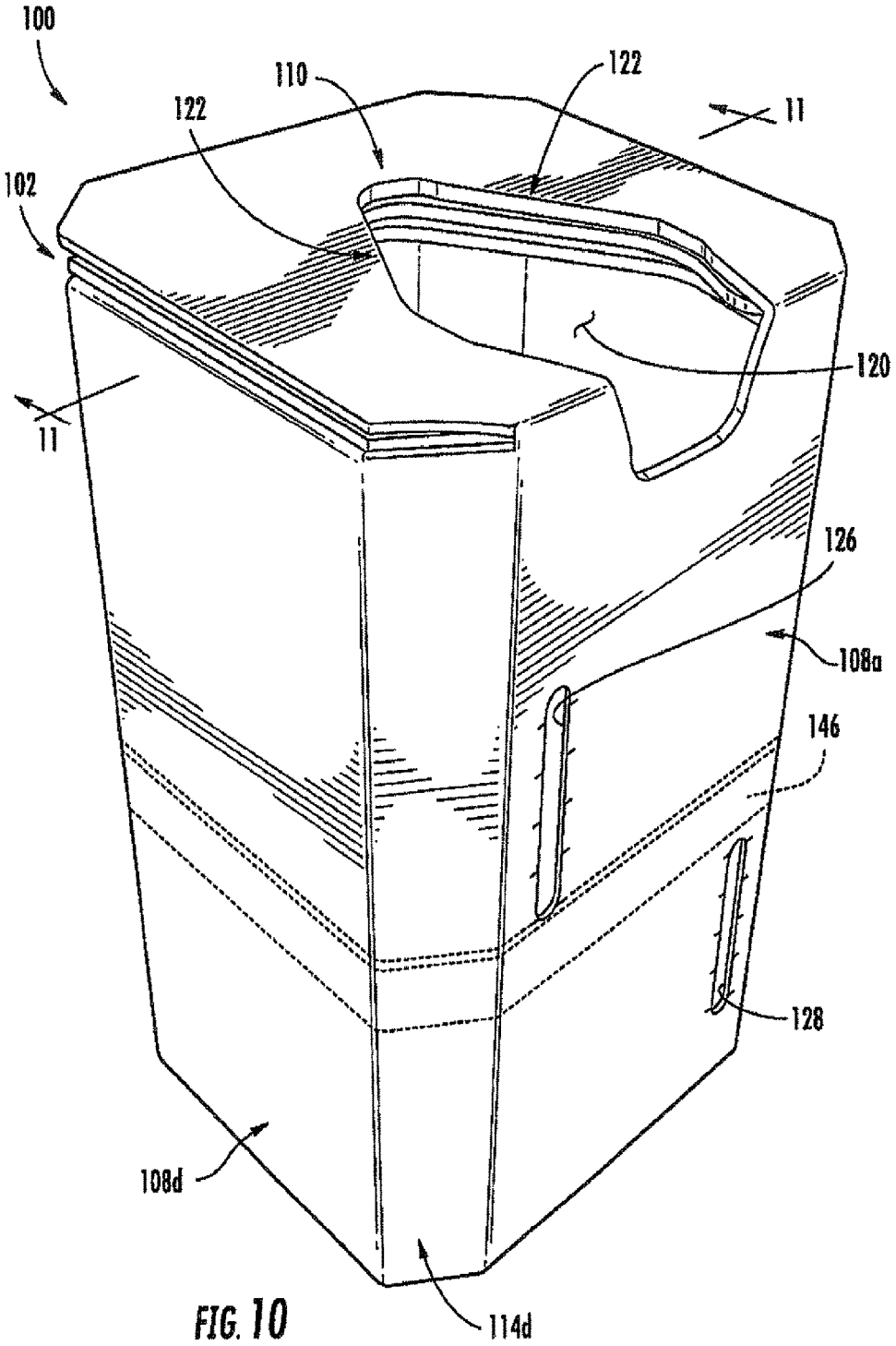
FIG. 10 is a perspective view of the container of the container assembly of FIG. 1.
Figure 11:
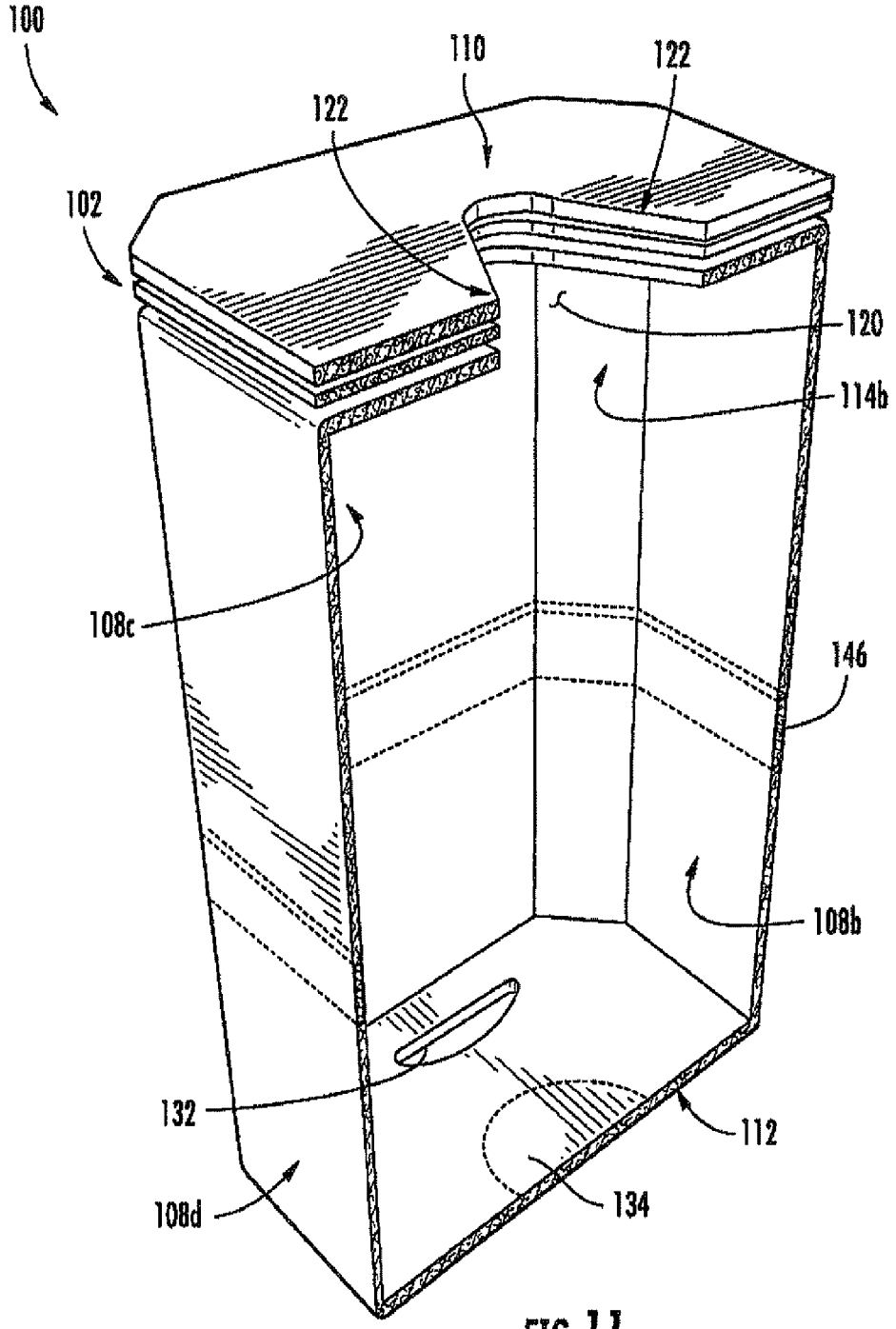
FIG. 11 is a section view of the container of FIG. 10 taken in a plane including line 11-11 in FIG. 10.

Referring now to FIGS. 10 and 11, the illustrated container 102 also includes reinforcing tape 146 (broadly, reinforcing material) extending through the side portions 108*a*, 108*b*, 108*c*, and 108*d* of the container 102 and generally around a perimeter of the container 102. The reinforcing tape 146 provides strength and structural stability to the side portions 108*a*, 108*b*, 108*c*, and 108*d* of the container 102 and helps protect the container 102 against bursting, tearing, etc. under stress (e.g., when the container assembly 100 is dropped with the receptacle 104 therein filled with fluid, etc.).

In the illustrated embodiment, the reinforcing tape 146 is installed within the side portions 108*a*, 108*b*, 108*c*, and 108*d* of the container 102 within corrugated structures of the side portions 108*a*, 108*b*, 108*c*, and 108*d*. Part of the reinforcing tape 146 hidden within the side portions 108*a*, 108*b*, 108*c*, and 108*d* and the corner portions 114*a*, 114*b*, 114*c*, and 114*d* of the container 102 is shown in broken lines. In the forward side portion 108*a* of the container 102, the first and second window openings 126 and 128 are spaced apart generally vertically along the container 102 so that the reinforcing tape 146 can extend adjacent (e.g., generally between, etc.) the first and second window openings 126 and 128. The reinforcing tape 146 may be constructed from any suitable materials within the scope of the present disclosure, including, for example, metal materials, composite materials, woven material, sesame band, etc.

In other example embodiments, containers may include reinforcing tape extending along surfaces of side portions of the containers (e.g., along inner surfaces of sidewall portions of containers, along outer surfaces of sidewall portions of containers, etc.). In still other example embodiments, reinforcing material may include labels, tape, etc. disposed along outer surfaces of containers and adjacent openings in the containers (e.g., window openings, etc.) to provide strength and structural stability to the side portions of the containers and to help protect the containers against bursting, tearing, etc. under stress.

The illustrated container 102 generally includes openings in the upper portion 110 and forward side portion 108*a*. Openings are not provided in side portions 108*b*, 108*c*, or 108*d*. This may help improve strength of the container 102, etc. In other example embodiments, however, containers may include side portions having openings differently than disclosed herein. In addition, the illustrated container 102 generally includes a flat lower portion 112 (e.g., free of flaps, etc.). This may help provide a level surface for stacking the container 102. In other example embodiments, however, containers may include lower surfaces with flaps.

The receptacle 104 of the illustrated container assembly 100 will now be described with reference to FIGS. 12-18. The receptacle 104 has a generally octagonal shape which provides strength (e.g., compression strength, etc.), structural integrity, and drop impact resistance to the receptacle 104. The receptacle 104 can be formed by any suitable process within the scope of the present disclosure including, for example, an extrusion blow molding process, etc.

Figure 12:
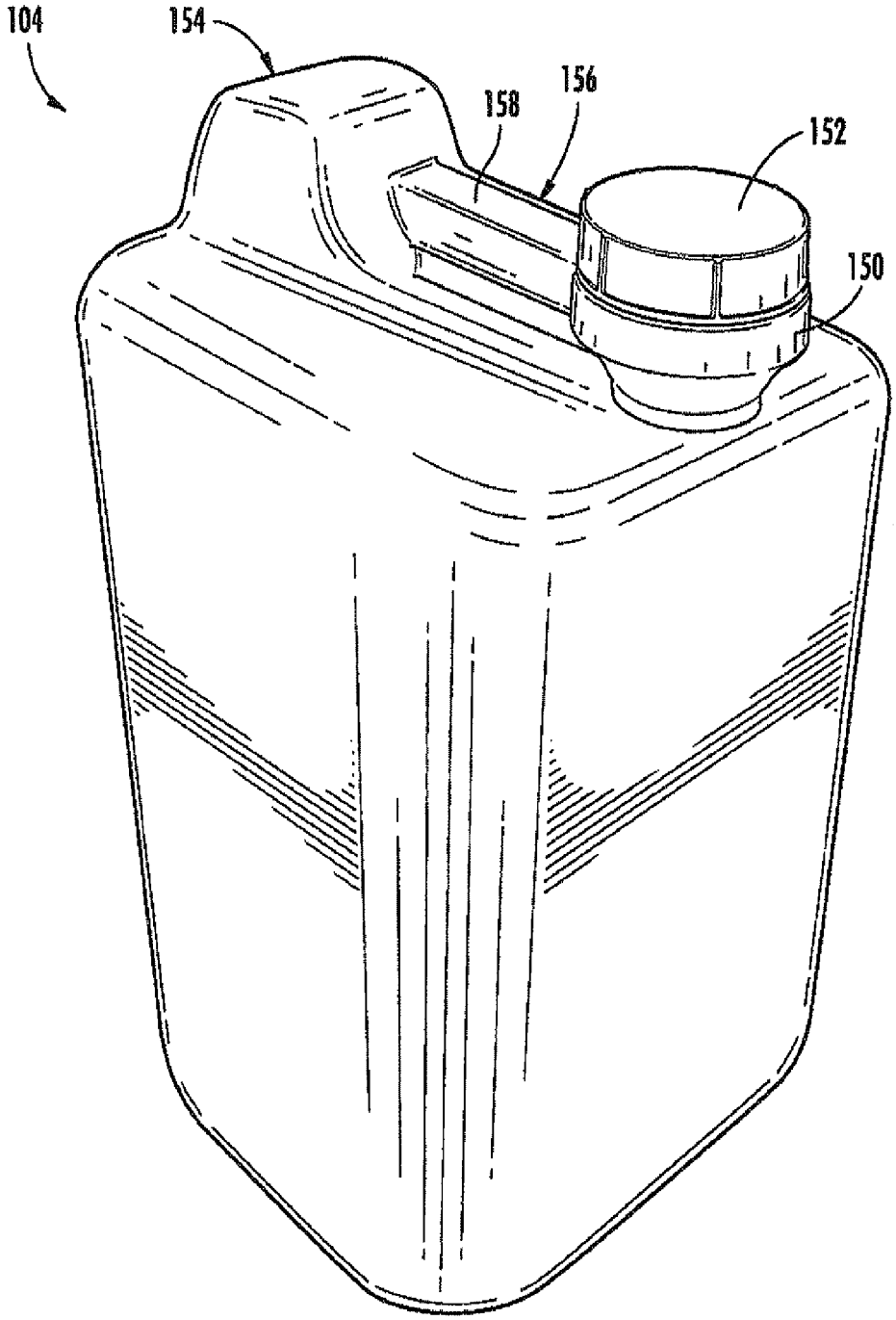
FIG. 12 is a perspective view of the receptacle of the container assembly of FIG. 1.
Figure 14:
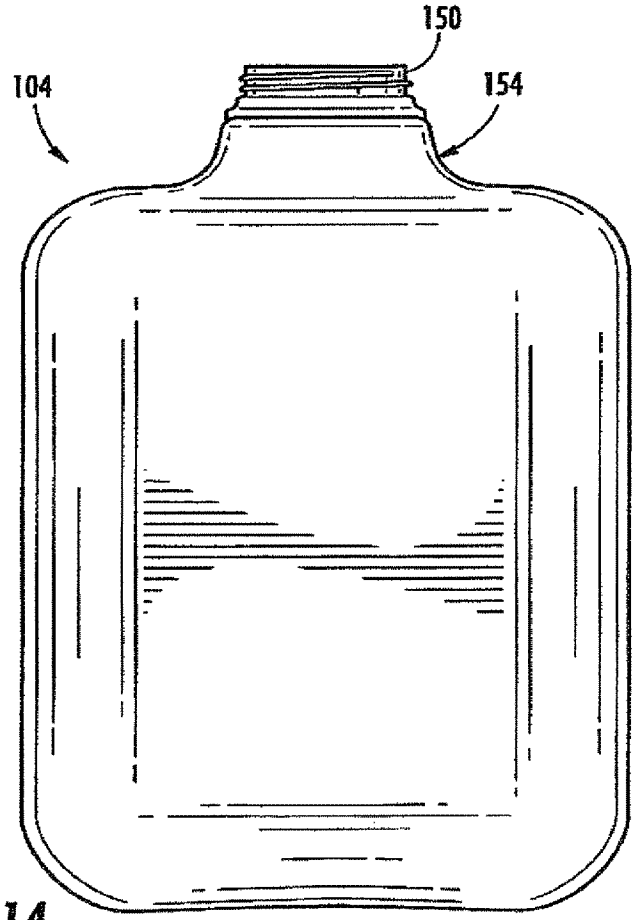
FIG. 14 is a rear elevation view of the receptacle of FIG. 12.
Figure 13:
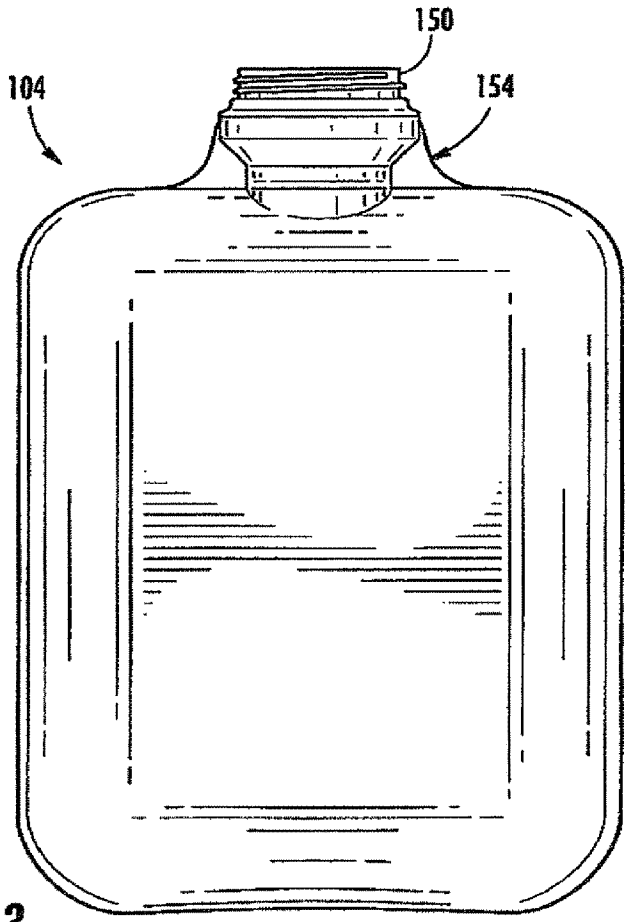
FIG. 13 is a front elevation view of the receptacle of FIG. 12.
Figure 16:
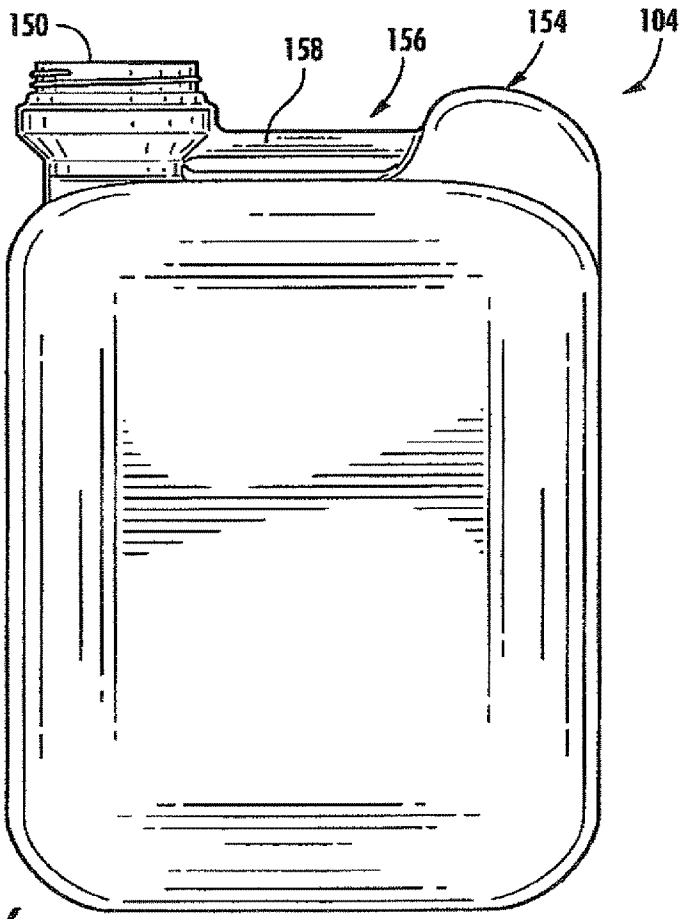
FIG. 16 is a right side elevation view of the receptacle of FIG. 12.
Figure 15:
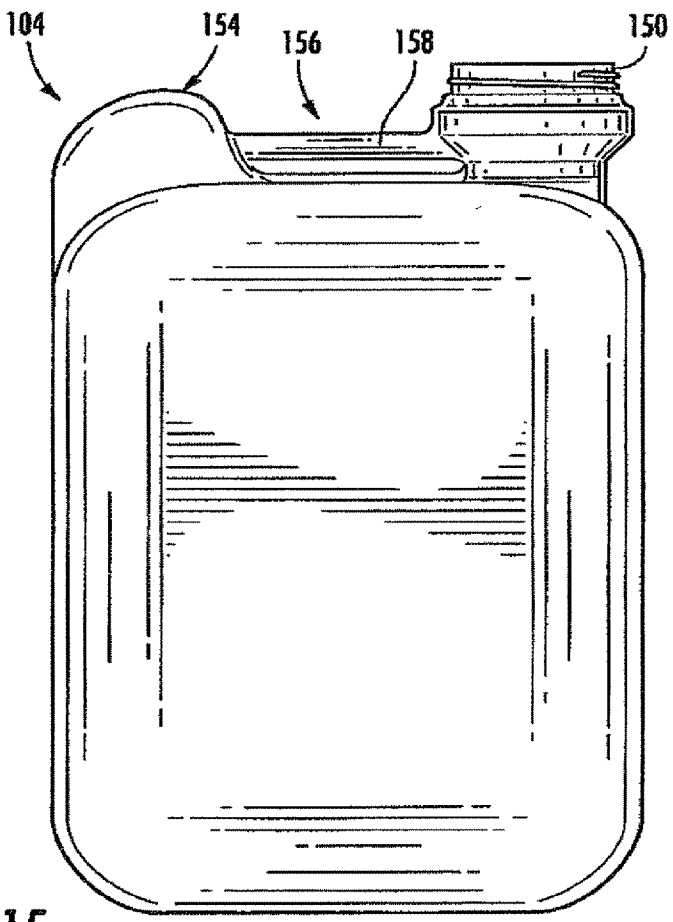
FIG. 15 is a left side elevation view of the receptacle of FIG. 12.
Figure 17:
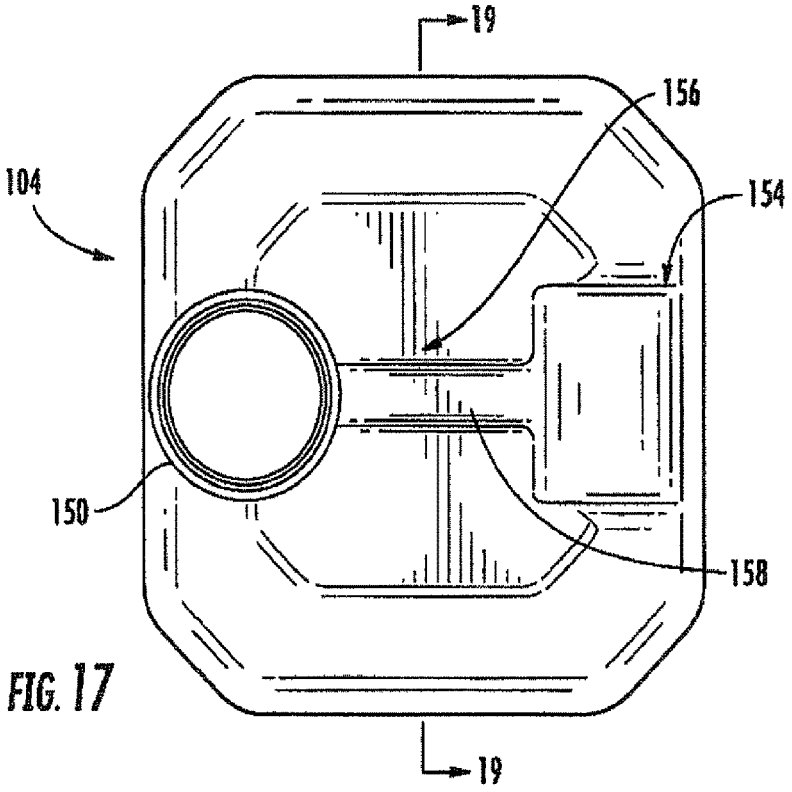
FIG. 17 is a top plan view of the receptacle of FIG. 12.
Figure 18:
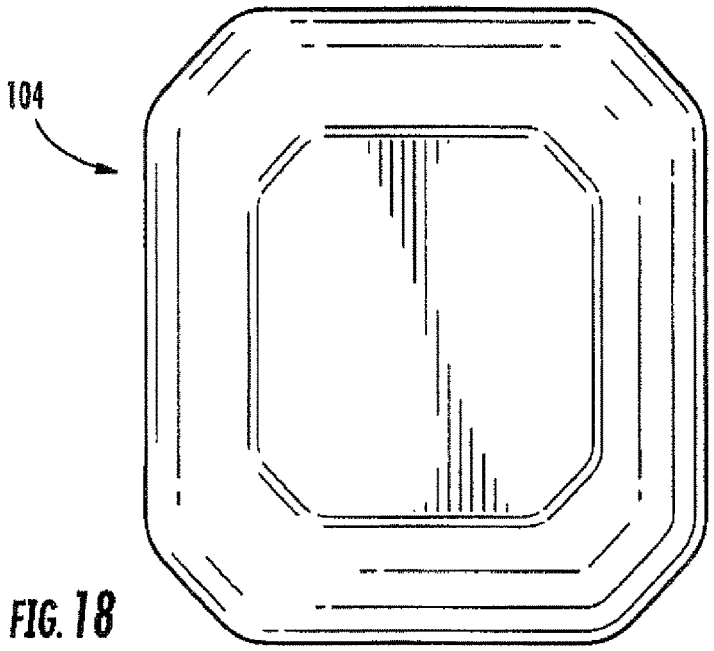
FIG. 18 is a bottom plan view of the receptacle of FIG. 12.
Figure 19:
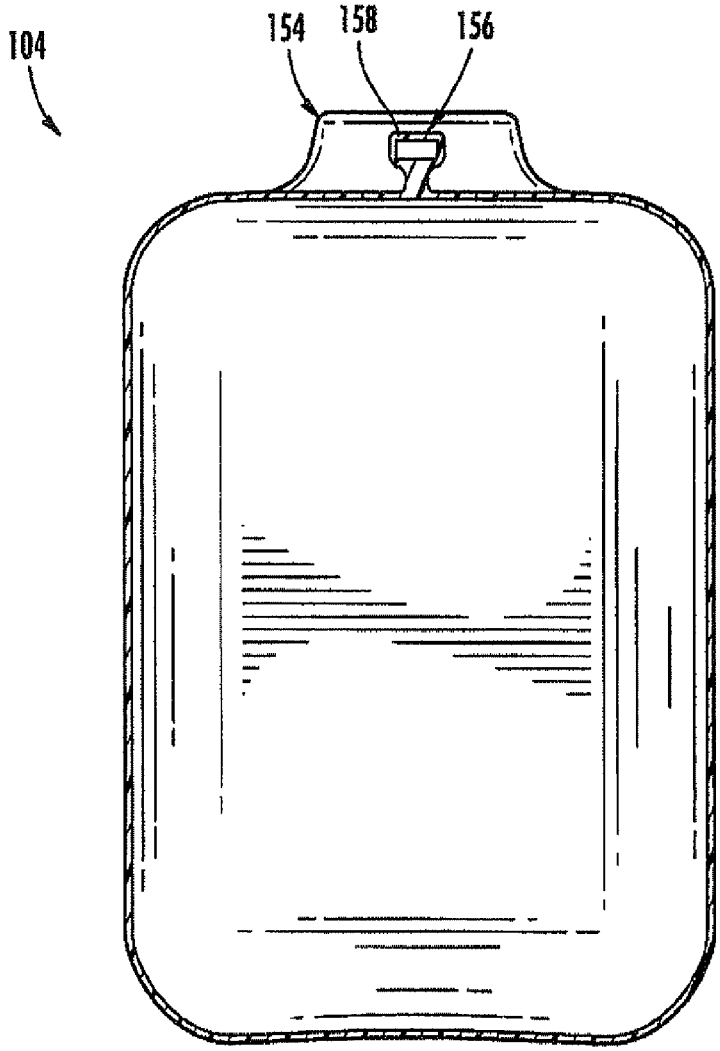
FIG. 19 is a section view of the receptacle of FIG. 12 taken in a plane including line 19-19 in FIG. 17.

As shown in FIG. 12, the receptacle 104 generally includes a spout 150 (broadly, an opening) in communication with the receptacle 104. The spout 150 is configured for receiving fluid into the receptacle 104 and/or for dispensing fluid from the receptacle 104. The spout 150 generally aligns with the access opening 120 of the container 102 when the receptacle 104 is disposed within the container 102 (see, FIGS. 1-3). This facilitates dispensing fluids from the receptacle 104 through the spout 150 and through the access opening 120 of the container 102 and allows for generally inline filling, closing, dispensing, etc. of the receptacle 104 in the container 102.

A cap 152 is removably coupled to the spout 150 and allows for selectively covering and uncovering the spout 150. A removable security seal (e.g., a peel liner, etc.) may be included over the spout 150 (and under the cap 152) as desired. When included, the security seal must be removed from the spout 150 in order to pour fluid from the receptacle 104. As such, the security seal could provide evidence that the receptacle 104 has not been altered or tampered with (e.g., that fluid within the receptacle 104 has not been altered or tampered with, etc.) prior to use. As an example, the security seal may be coupled (e.g., induction welded, etc.) to the receptacle 104 such that the security seal substantially covers the spout 150 and can be easily removed when desired to access the spout 150 (e.g., pour fluid from the receptacle 104, etc.). Other types of removable security seals may be used in connection with the cap 152 and/or spout 150 of the receptacle 104 within the scope of the present disclosure (e.g., perforated sealing rings used in connection with the cap 152, etc.).

The receptacle 104 also includes a shoulder 154 (broadly, a support portion) in communication with the receptacle 104 and the spout 150. The shoulder 154 is configured to position adjacent the upper portion 110 of the container 102 when the receptacle 104 is disposed within the container 102. In this position, the shoulder 154 engages the upper portion 110 of the container 102 when, for example, the container assembly 100 is manipulated to pour fluid from the receptacle 104 (see, FIG. 8). As such, the shoulder 154 supports the receptacle 104 within the container 102 generally against the upper portion 110 of the container 102 to help inhibit undesired sliding movement of the receptacle 104 that could affect, inhibit, etc. fluid pouring operation. The shoulder 154 also creates room within the container 102 between the receptacle 104 and the upper portion 110 of the container 102 for users to grasp the gripping portions 122 of the container 102 (such that the users' fingers can fit generally within the container 102 between the receptacle 104 and the upper portion 110 of the container 102).

With continued reference to FIG. 12, the receptacle 104 also includes a vent structure 156 that promotes easy pouring of fluid from the receptacle 104. More particularly, the vent structure 156 provides a generally uniform, smooth, continuous flow of fluid from the receptacle 104 (e.g., a "no-glug" flow of fluid, a generally steady stream of fluid flow, etc.) when users manipulate the container assembly 100 to pour fluid from the receptacle 104. This can help reduce splashing of the fluid as the fluid pours from the receptacle 104 (as well as the risk of inadvertent fluid contact with users while pouring).

In the illustrated embodiment, the vent structure 156 of the receptacle 104 generally includes a neck 158 extending along an upper portion of the receptacle 104 between the spout 150 and the shoulder 154. The neck 158 is formed monolithically with the receptacle 104 and defines a generally pinched channel extending from the spout 150 to the shoulder 154. The neck 158 is generally sealed from the fluid within the receptacle 104 (via the pinched channel construction of the neck 158), and is generally open at the spout 150 and at the shoulder 154. As such, the neck 158 allows air to enter the neck 158 from the spout 150, move through the neck 158 to the shoulder 154, and then circulate within the receptacle 104 as fluid is poured (i.e., generally behind the fluid being poured via the shoulder 154). This inhibits pressure differentials from forming within the receptacle 104 during pouring operation, and thus promotes the uniform, smooth, continuous flow of fluid from the receptacle 104.

The illustrated receptacle 104 does not include a handle for grasping and lifting the receptacle 104. Lifting the receptacle 104 when filled with fluid is accomplished by grasping the gripping portions 122 of the container 102 and moving the container 102 and receptacle 104 together. Thus, structural flexing of the receptacle 104 (e.g., in the vent structure 156, etc.) when being carried is reduced. As such, wall thicknesses of the receptacle 104 can be reduced resulting in use of less plastic when forming the receptacle 104.

Figure 20:
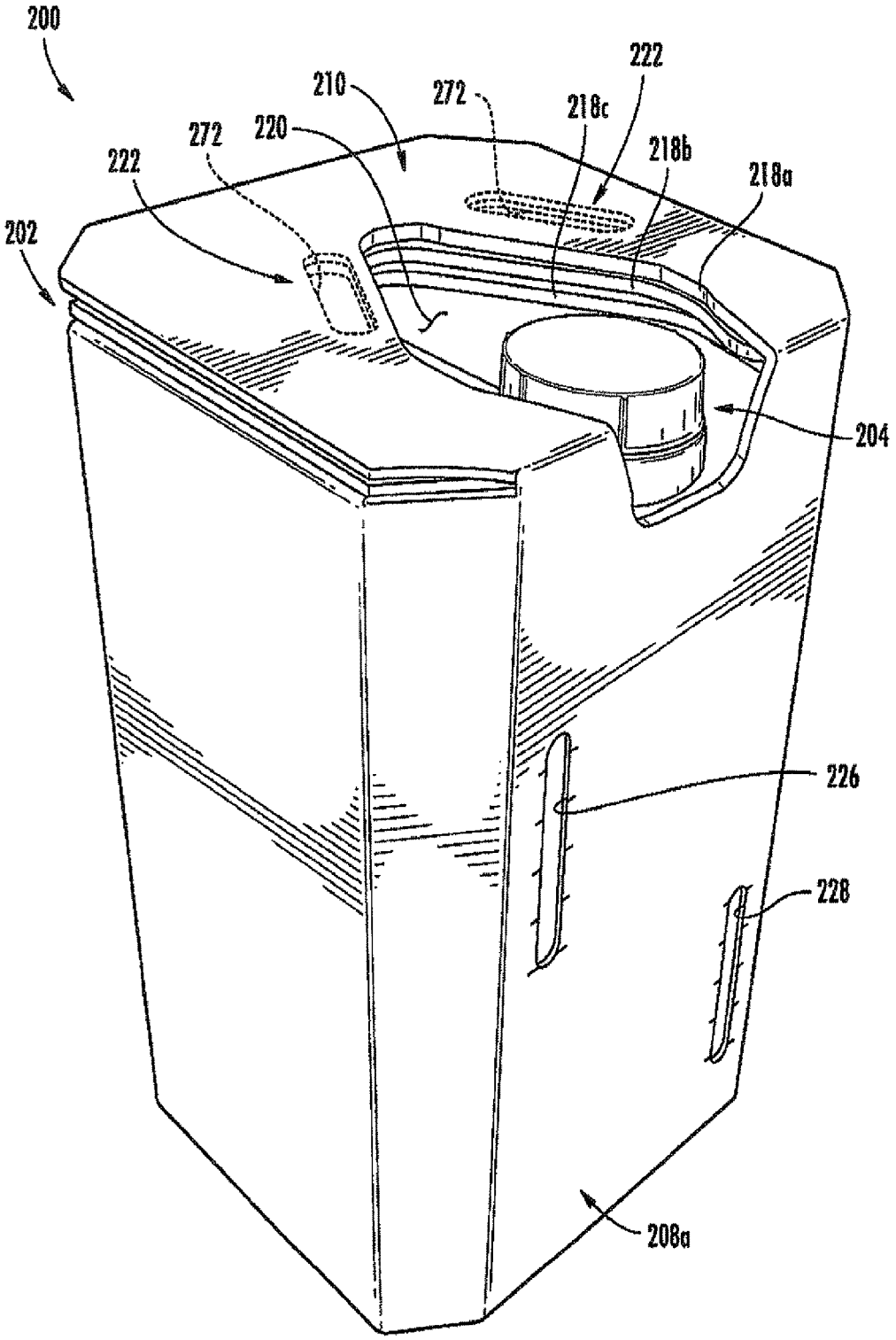
FIG. 20 is a perspective view of another example container assembly including one or more aspects of the present disclosure.

FIG. 20 illustrates another example embodiment of a container assembly 200 including one or more aspects of the present disclosure. The container assembly 200 of this embodiment is substantially similar to the container assembly 100 previously described and illustrated in FIGS. 1-19. For example, the container assembly 200 includes a container 202 and a receptacle 204 configured to fit within the container 202. An access opening 220 is defined in an upper portion 210 of the container 202 as well as in a forward side portion 208*a* of the container 202. And, first and second window openings 226 and 228 are defined in the container's forward side portion 208*a*.

In addition in the illustrated container assembly 200, the container 202 includes two internal finger openings 272 each positioned on an opposing side of the access opening 220. The finger openings 272 are defined through interior layers 218*b* and 218*c* of the upper portion 210 to help users secure grips at gripping portions 222. In this example embodiment, the finger openings are not defined through layer 218*a* of the upper portion 210 of the container 202. As such, the finger openings 272 are hidden in FIG. 20 and are thus shown in broken lines to illustrate general location.

Figure 21:
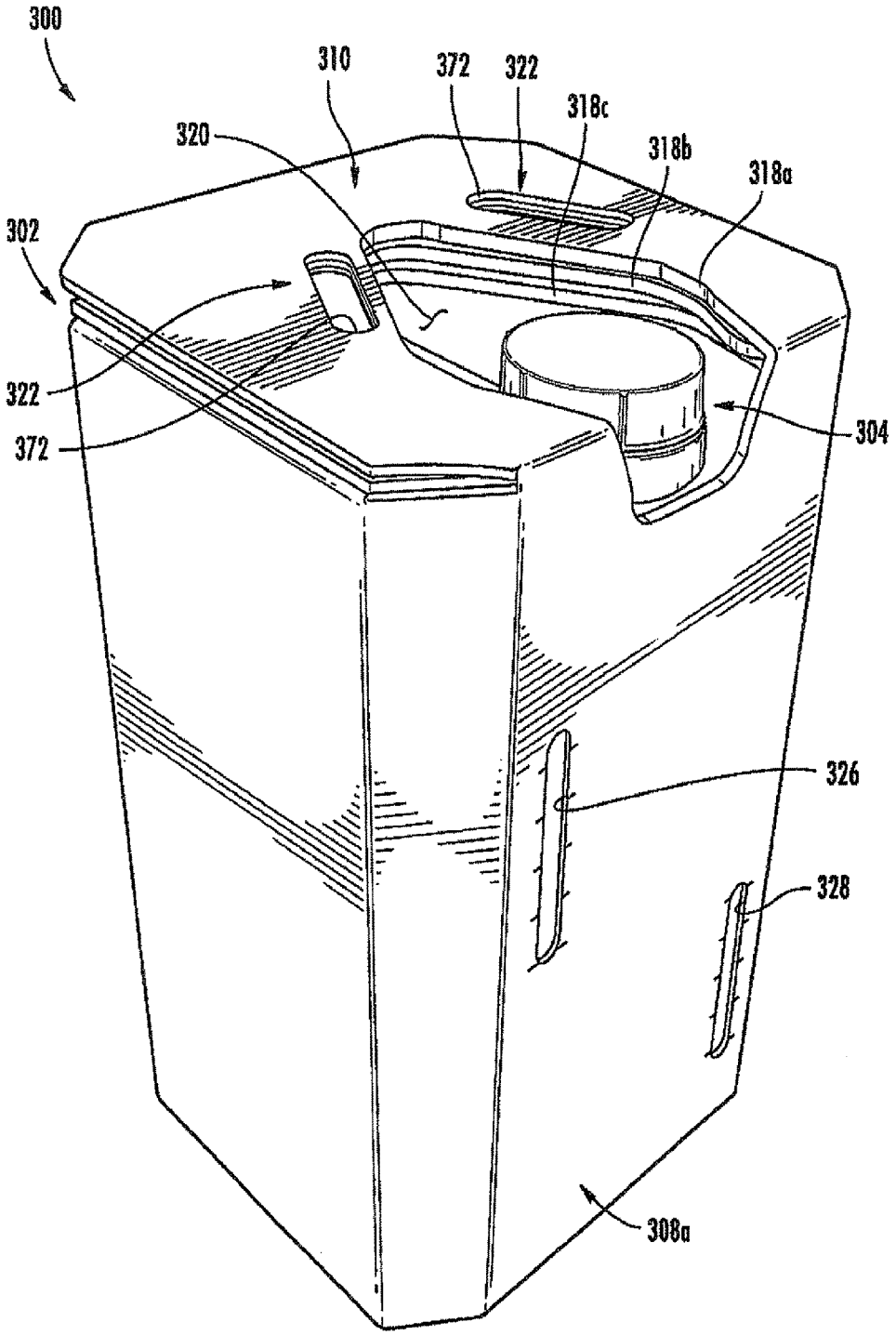
FIG. 21 is a perspective view of still another example container assembly including one or more aspects of the present disclosure.

FIG. 21 illustrates an example embodiment of a container assembly 300 substantially similar to the container assembly 200 previously described and illustrated in FIG. 20. For example, the container assembly 300 includes a container 302 and a receptacle 304 configured to fit within the container 302. An access opening 320 is defined in an upper portion 310 of the container 302 as well as in a forward side portion 308*a* of the container 302. First and second window openings 326 and 328 are defined in the container's forward side portion 208*a*. And, the container 302 includes two internal finger openings 372 each positioned on an opposing side of the access opening 320. In this embodiment, the finger openings 372 are defined through each of layers 318*a*, 318*b*, and 318*c* of the upper portion 310 to help users secure grips at gripping portions 322.

Figure 22:
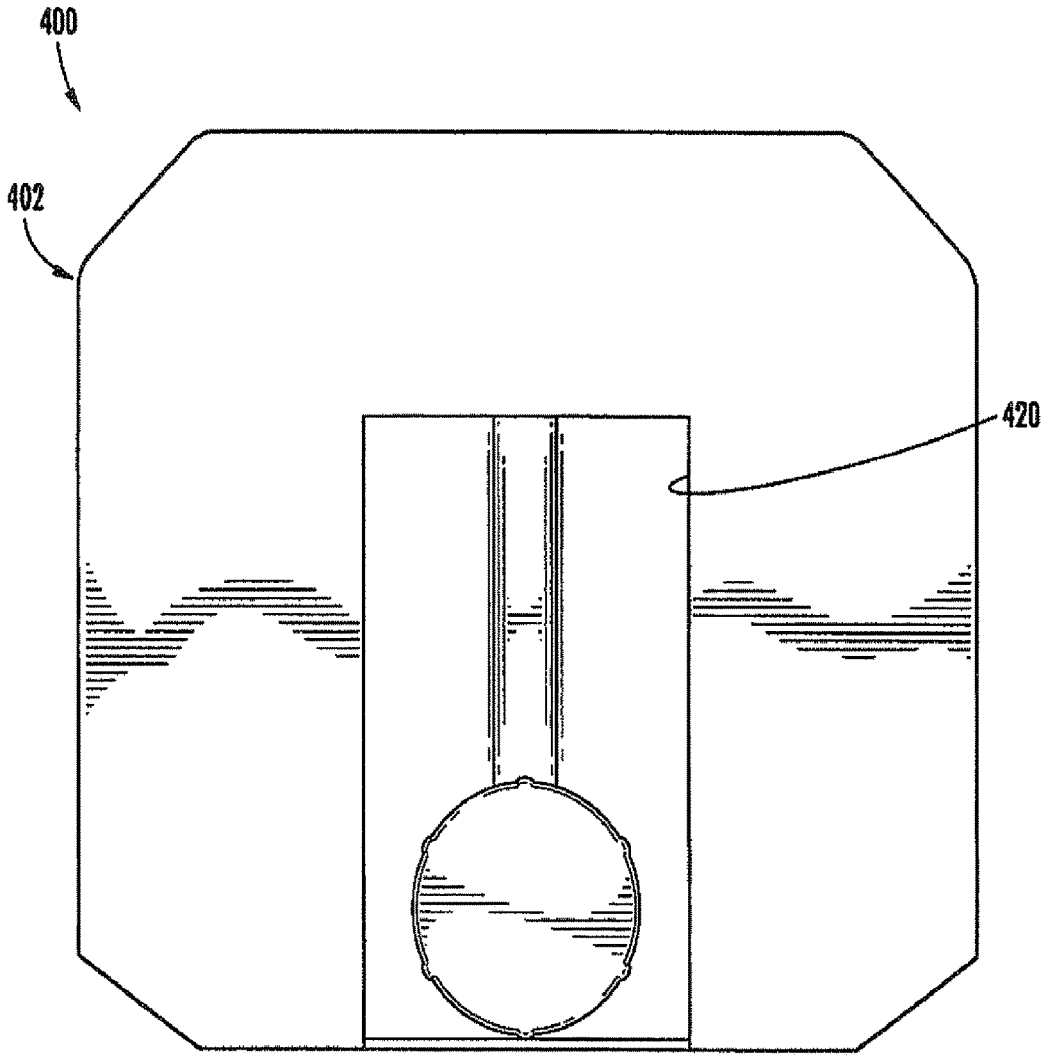
FIG. 22 is a top plan view of an example container assembly including one or more aspects of the present disclosure and having a generally square-shaped access opening formed in an upper portion of a container thereof.
Figure 23:
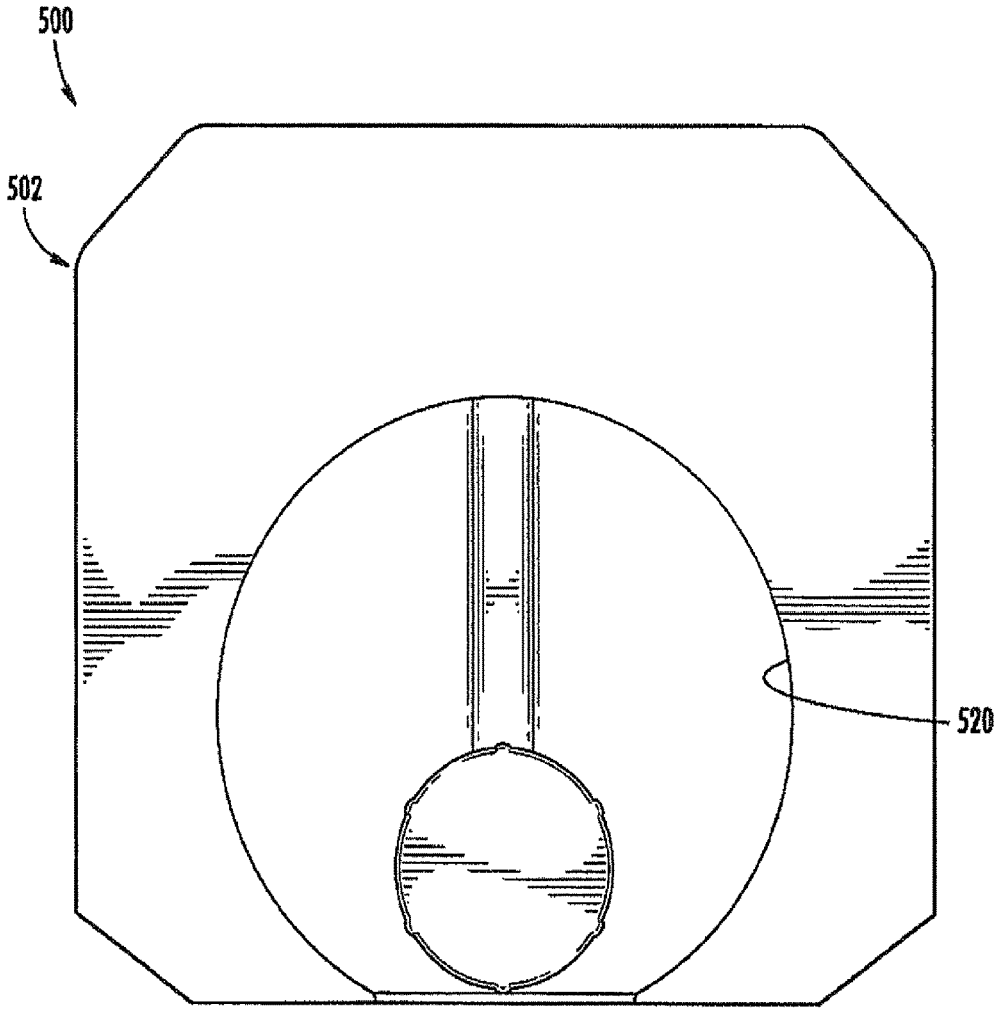
FIG. 23 is a top plan view of another example container assembly including one or more aspects of the present disclosure and having a generally circular-shaped access opening formed in an upper portion of a container thereof.

FIGS. 22 and 23 illustrate additional example embodiments of container assemblies including one or more aspects of the present disclosure. In these example embodiments, the container assemblies include containers having alternative designs for access openings in upper portions of the containers for accessing receptacles within the containers. For example, FIG. 22 illustrates a container assembly 400 in which a container 402 includes a generally square-shaped access opening 420. And, FIG. 23 illustrates a container assembly 500 in which a container 502 includes a generally circular-shaped access opening 520.

FIGS. 24-30 illustrate more additional example embodiments of container assemblies including one or more aspects of the present disclosure. In these example embodiments, the container assemblies include containers having alternative designs for window openings located in side portions of the containers for viewing, for example, fluid level in receptacles disposed within the containers.

Figure 24:
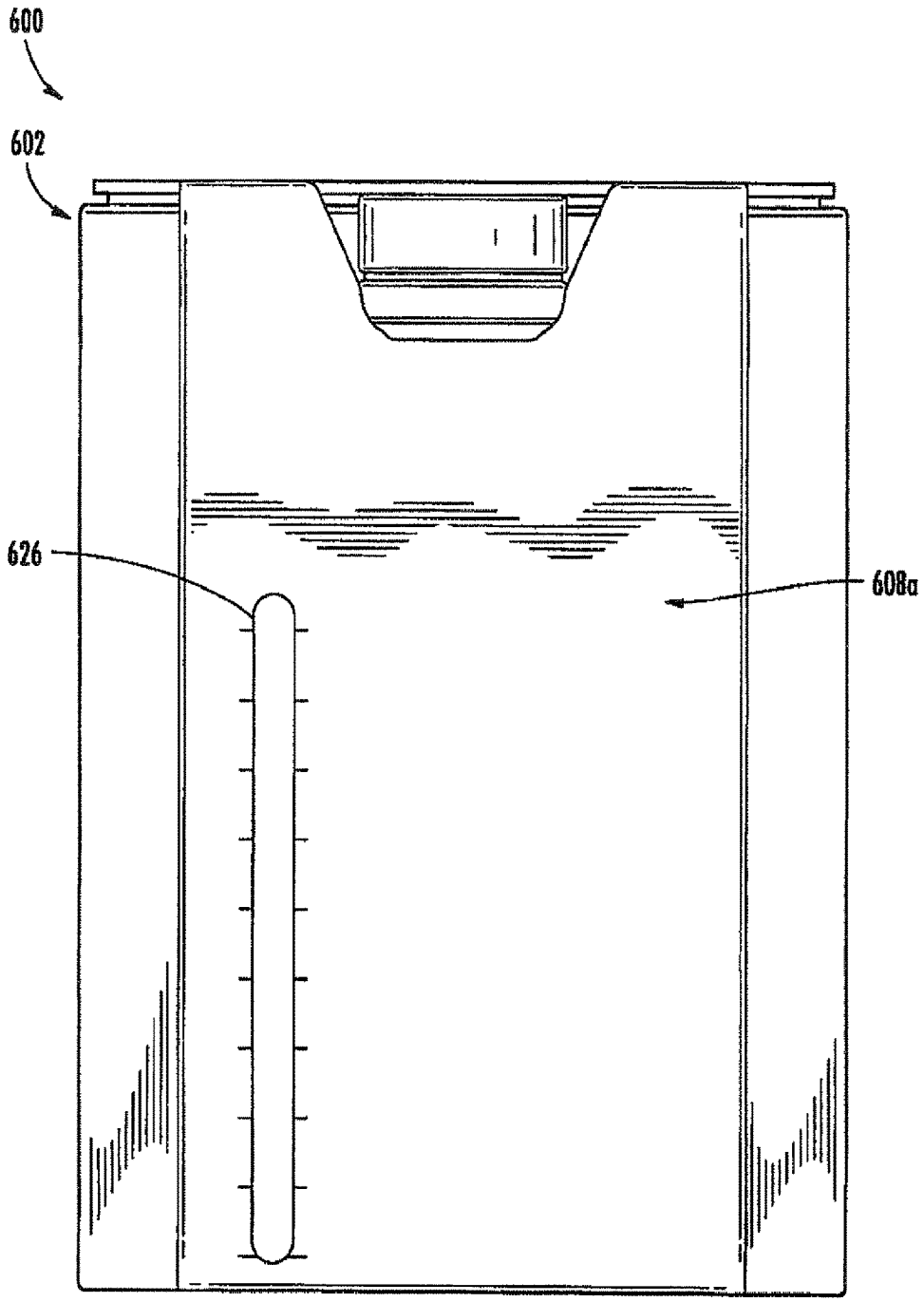
FIG. 24 is a front elevation view of an example container assembly including one or more aspects of the present disclosure and having a single window opening formed in a forward side portion of a container thereof.
Figure 25:
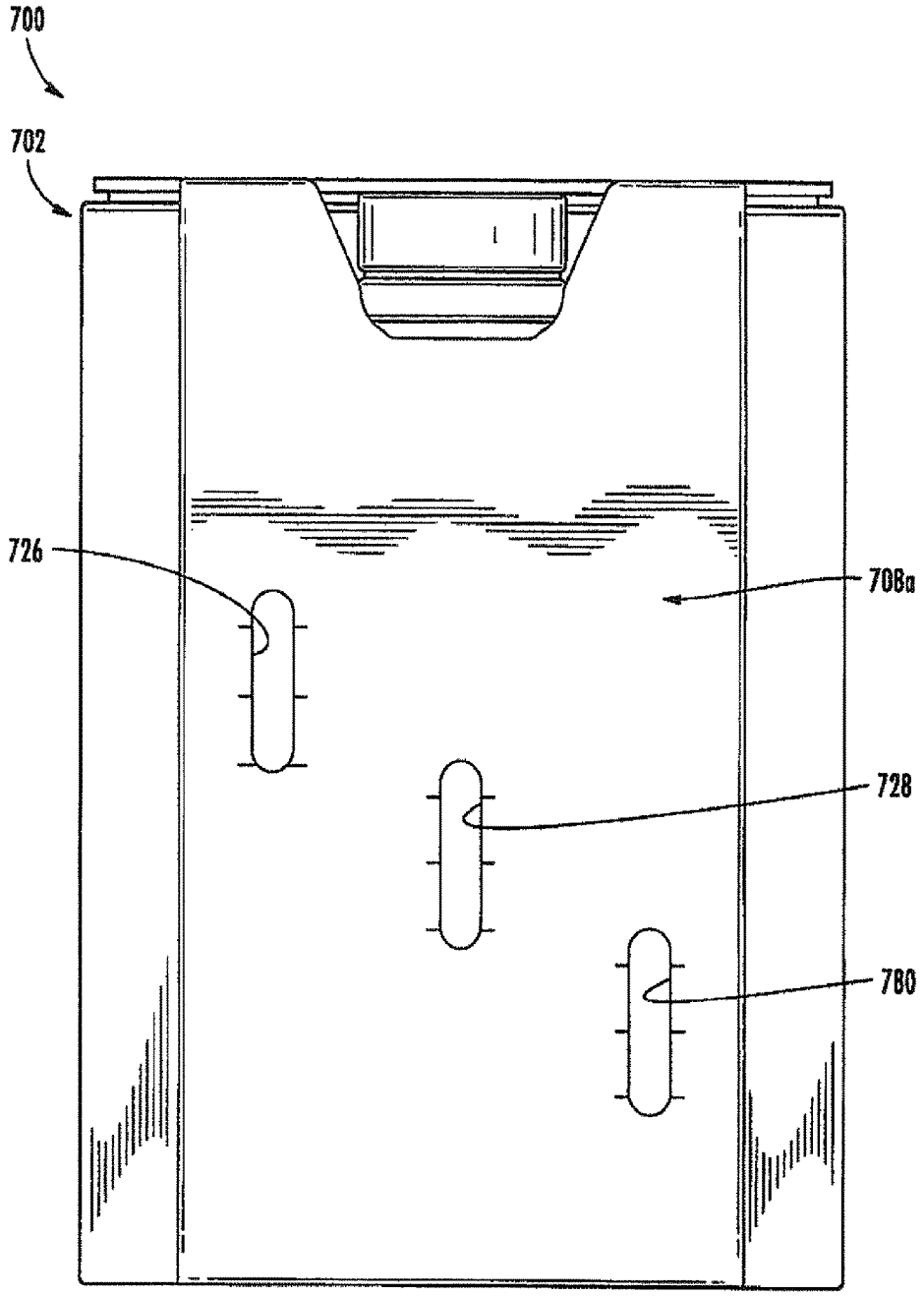
FIG. 25 is a front elevation view of another example container assembly including one or more aspects of the present disclosure and having three window openings formed in a forward side portion of a container thereof.
Figure 26:
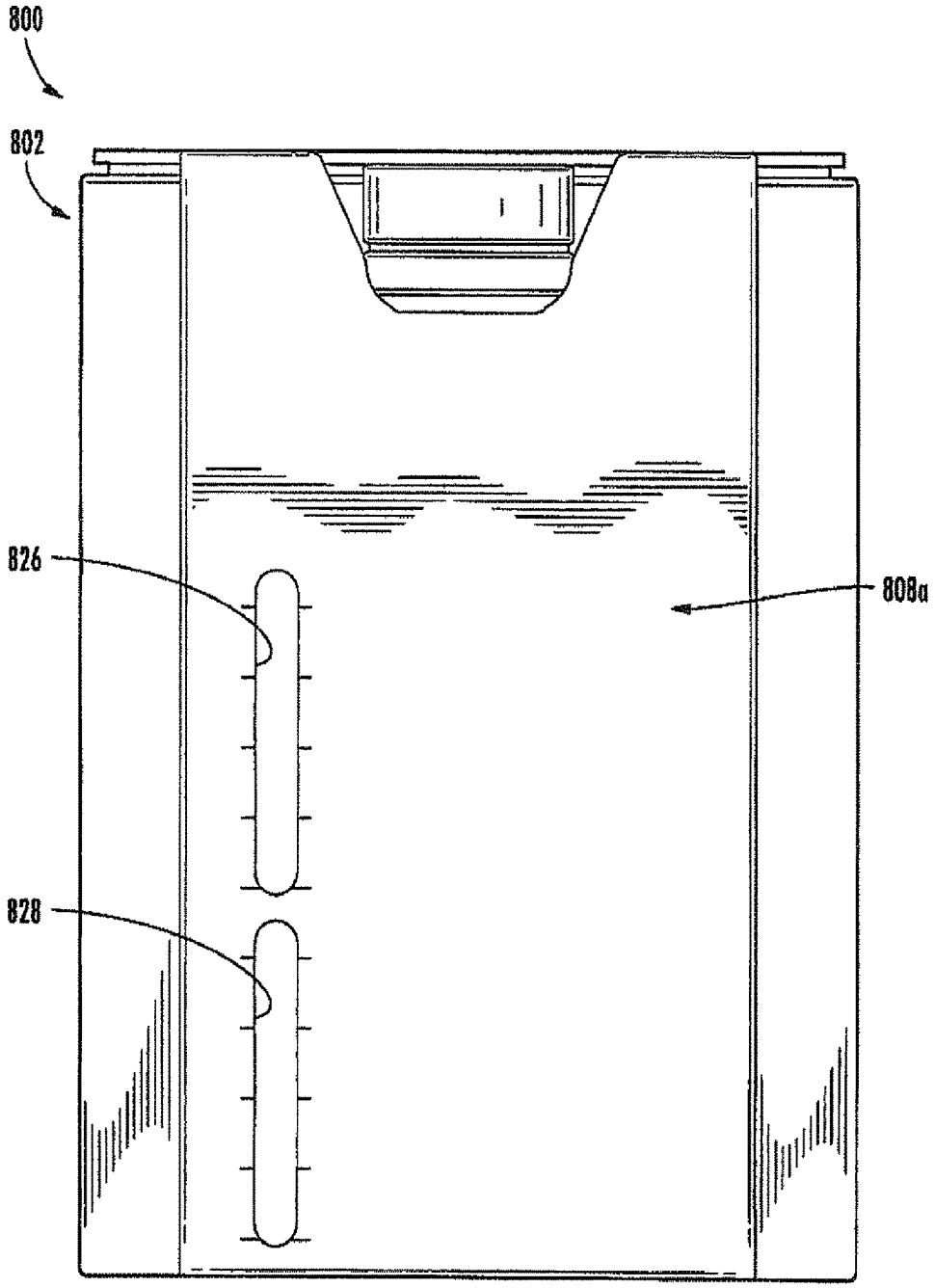
FIG. 26 is a front elevation view of an example container assembly including one or more aspects of the present disclosure and having two generally vertically aligned window openings formed in a forward side portion of a container thereof.
Figure 27:
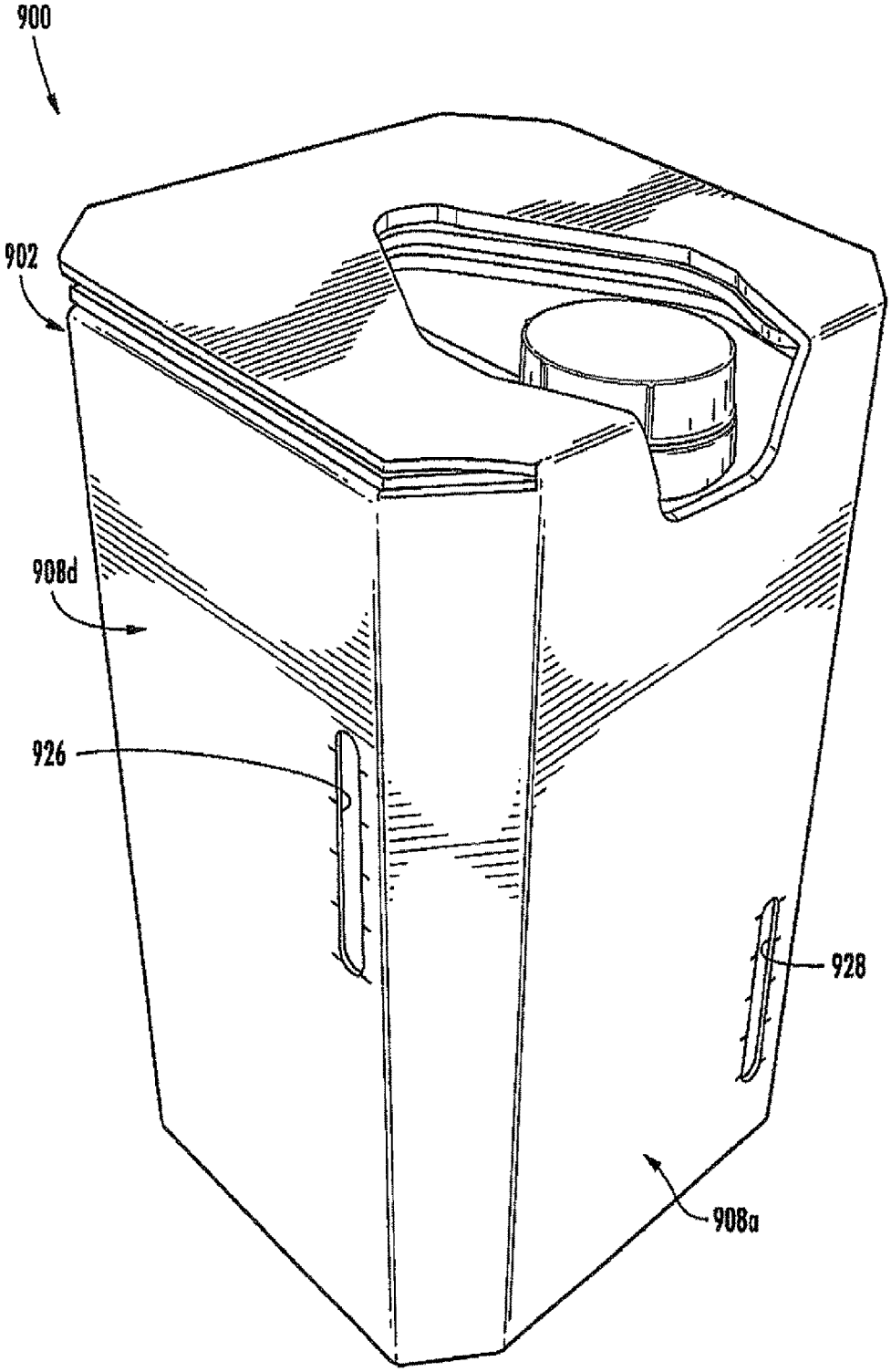
FIG. 27 is a perspective view of another example container assembly including one or more aspects of the present disclosure and having a window openings formed in a forward side portion and a left side portion of a container thereof.
Figure 28:
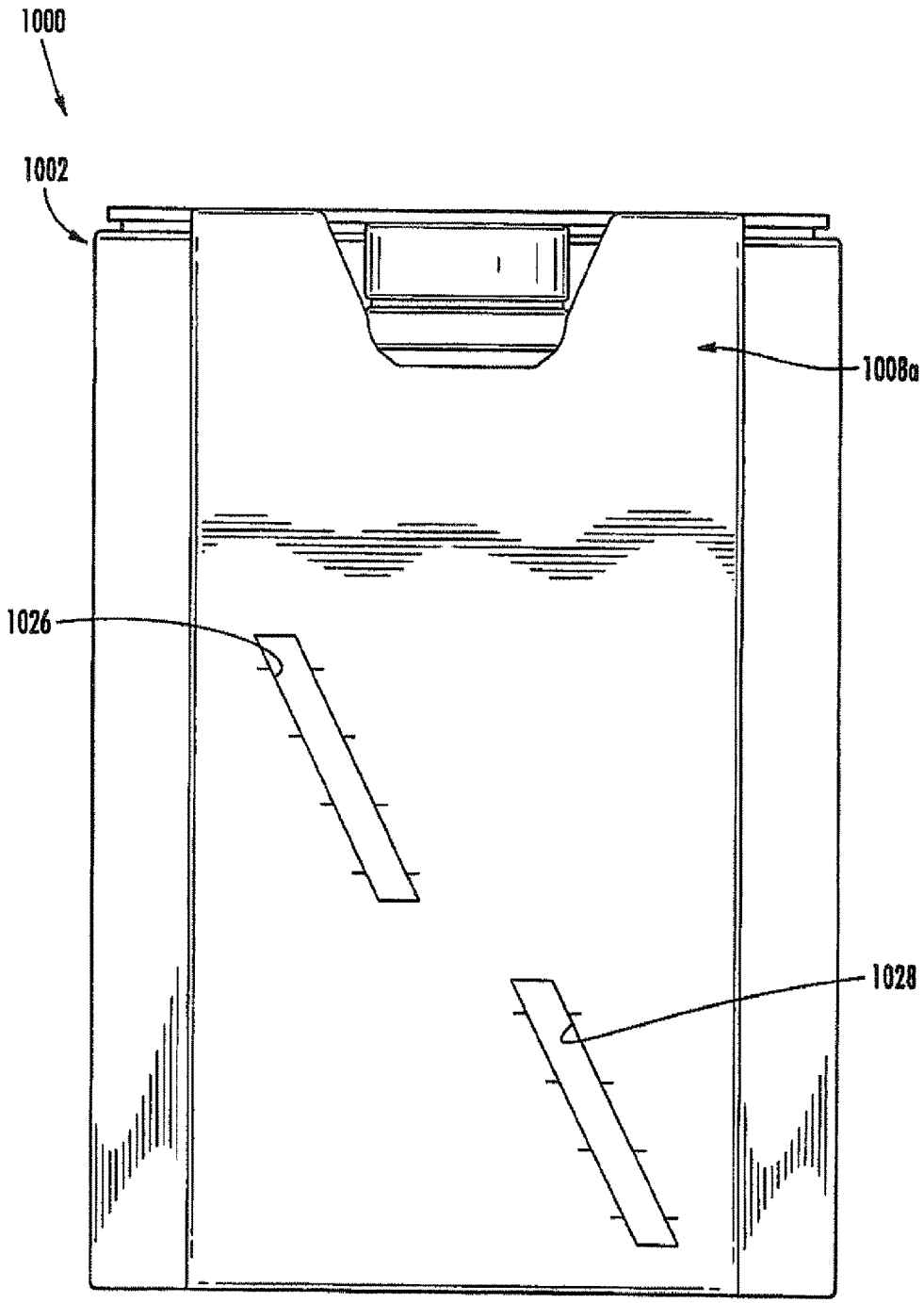
FIG. 28 is a front elevation view of another example container assembly including one or more aspects of the present disclosure and having two generally diagonal window openings formed in a forward side portion of a container thereof.
Figure 29:
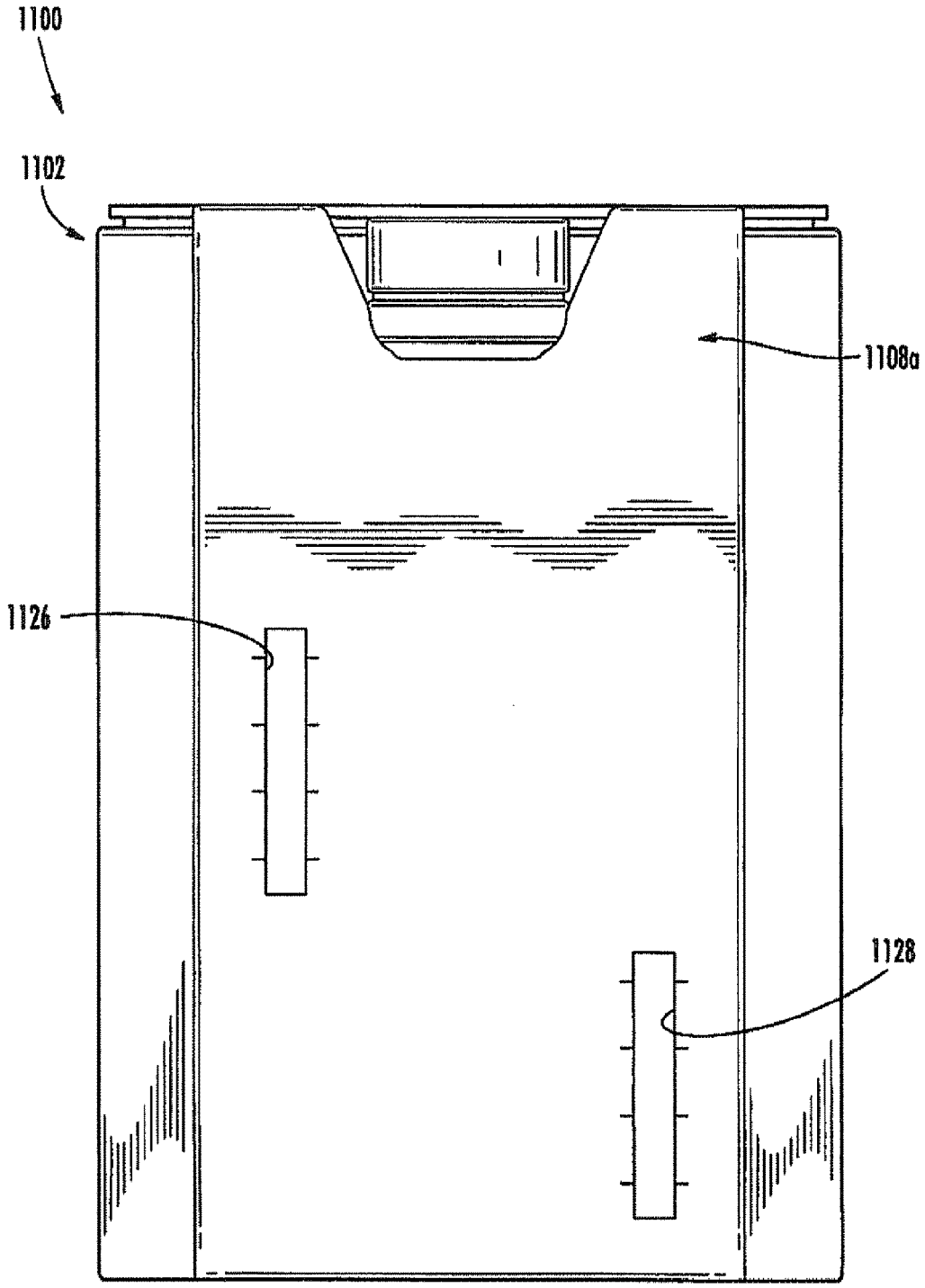
FIG. 29 is a front elevation view of still another example container assembly including one or more aspects of the present disclosure and having two window openings formed in a forward side portion of a container thereof.
Figure 30:
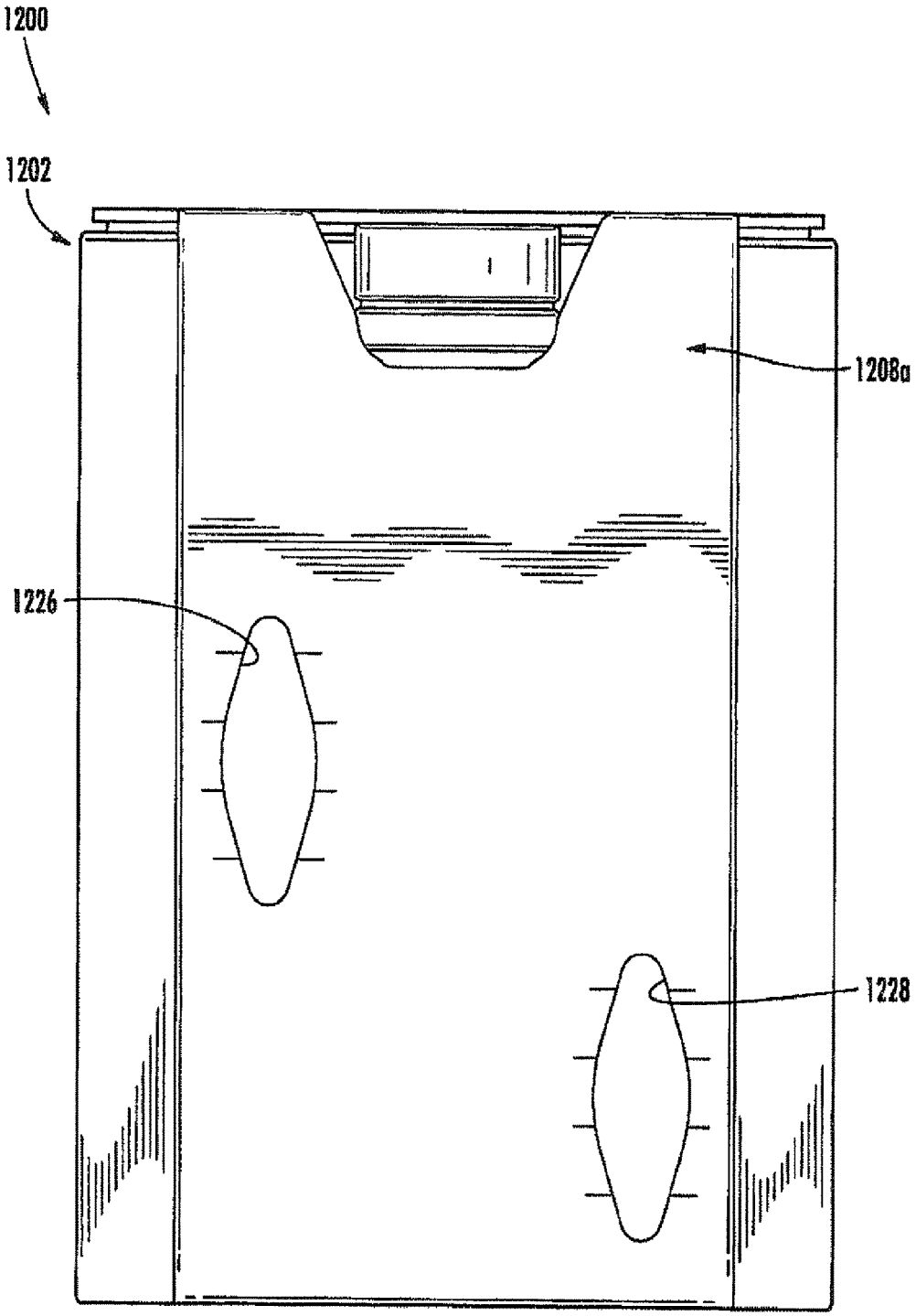
FIG. 30 is a front elevation view of an example container assembly including one or more aspects of the present disclosure and having two window openings formed in a forward side portion of a container thereof.

For example, FIG. 24 illustrates a container assembly 600 in which a container 602 thereof includes a single window opening 626 generally vertically oriented along a forward side portion 608*a* of the container 602. FIG. 25 illustrates a container assembly 700 in which a container 702 thereof includes three window openings 726, 728, and 780 offset and generally vertically oriented along a forward side portion 708*a* of the container 702. FIG. 26 illustrates a container assembly 800 in which a container 802 thereof includes two window openings 826 and 828 generally vertically oriented along a forward side portion 808*a* of the container 802. FIG. 27 illustrates a container assembly 900 in which a container 902 thereof includes a first window opening 926 generally vertically oriented along a left side portion 908*d* of the container 902 and a second window opening 928 generally vertically oriented along a forward side portion 908*a* of the container 902. FIG. 28 illustrates a container assembly 1000 in which a container 1002 thereof includes first and second window openings 1026 and 1028 each generally diagonally oriented along a forward side portion 1008*a* of the container 1002. FIG. 29 illustrates a container assembly 1100 in which a container 1102 thereof includes window openings 1126 and 1128 in a forward side portion 1108*a* of the container 1102 having generally square end portions. And, FIG. 30 illustrates a container assembly 1200 in which a container 1202 thereof includes window openings 1226 and 1228 in a forward side portion 1208*a* and having generally non-uniform shapes. In still other example embodiments, container assemblies may include containers having different numbers of window openings, different shapes of window openings, different orientations of window openings, etc. than disclosed herein.

Figure 31:
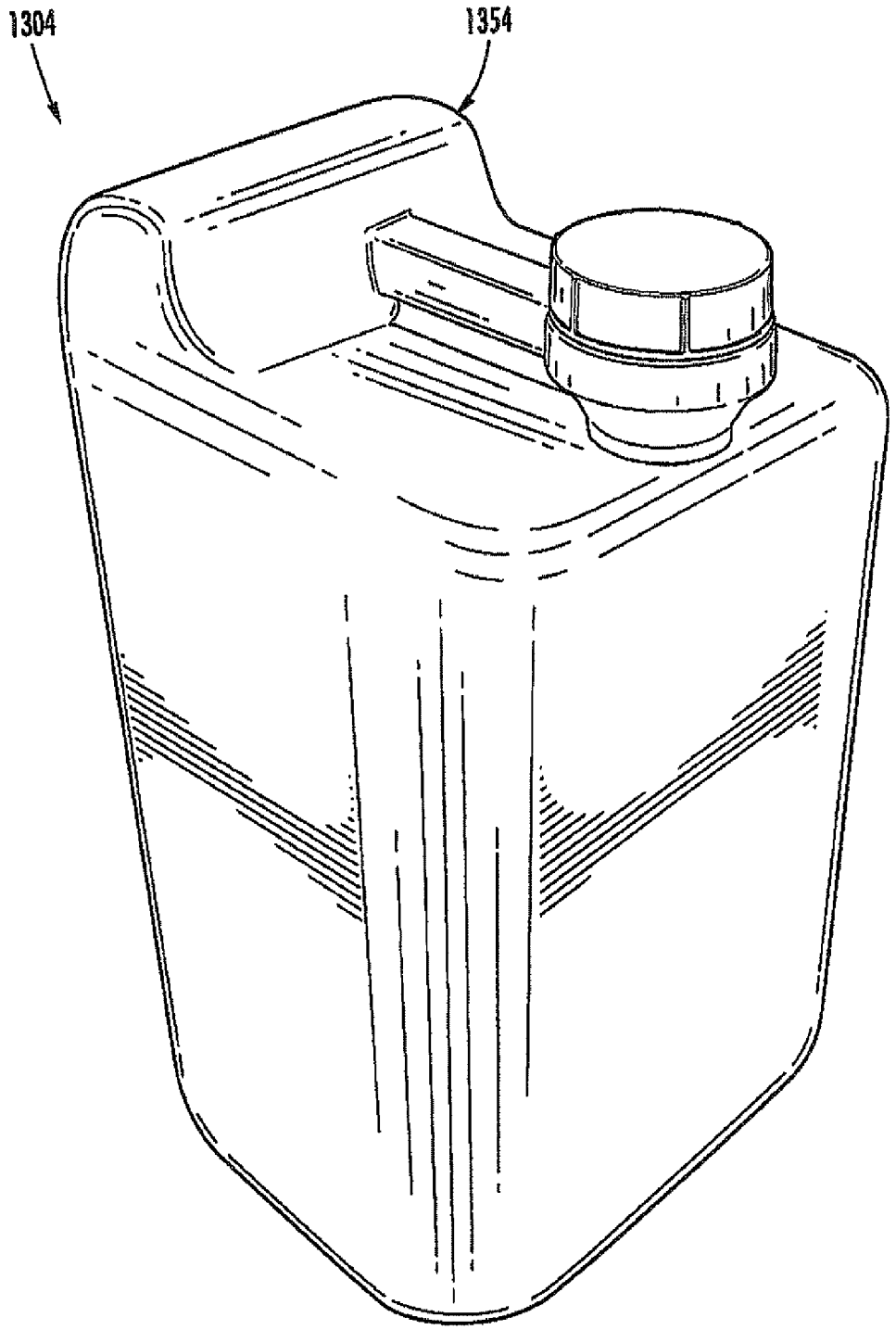
FIG. 31 is a perspective view of another example receptacle for use with a container assembly including one or more aspects of the present disclosure.

FIG. 31 illustrates an example embodiment of a receptacle 1304 for use with a container assembly including one or more aspects of the present disclosure. In this example embodiment, the receptacle 1304 includes an alternative design for a shoulder 1354. The shoulder 1354 supports the receptacle 1304 within a container generally against an upper portion of the container to help inhibit undesired sliding movement of the receptacle 1304 within the container while pouring fluid from the receptacle 1354 (when the receptacle 1354 is disposed within the container).

In another example embodiment, a container assembly includes a container and a receptacle configured to fit within the container. In this example embodiment, the container has a length (or depth) dimension of about 10 inches (about 25.4 centimeters), a width dimension of about 9 inches (about 22.9 centimeters), and a height dimension of about 14.25 inches (about 36.2 centimeters). And, the receptacle has a volume of about 3 gallons (about 11.4 liters). In addition, walls of the receptacle may have a nominal thickness of about 0.03 inches (about 0.762 millimeters). In other example embodiments, container assemblies may include containers having different dimensions than described herein and/or receptacles having volumes other than about 3 gallons (e.g., about 3.5 gallons (about 13 liters, etc.). In still other example embodiments, container assemblies may have receptacles sized to hold sufficient fluid to dose a particular area of land (e.g., about 20 acres of land, etc.).

Other example embodiments of the present disclosure relate to methods of preparing container assemblies for use in storing, shipping, and/or dispensing fluid. In one example embodiment, a blank of material is initially formed to a desired shape for use in forming a container of the container assembly. Features such as access openings (broadly, a first group of openings), window openings (broadly, a second group of openings), finger openings, and knockouts can be formed (e.g., stamped, cut, etc.) in the blank of material as desired, for example, while forming the blank of material to the desired shape. The access openings, for example, are positioned in overlapping portions of the blank of material so that they generally align when the container is formed (i.e., to thereby form a single access opening in the container). Similarly, respective finger openings are positioned to generally align when the container is formed. In addition, desired artwork, trade dress, product instructions, product warnings, etc. may be printed on the blank of material and/or document holding compartments (e.g., for product booklets, etc.) may be formed on the blank of material as desired, Any suitable material may be used to form the blank of material, far example, corrugated material, cardboard, etc. And, the blank of material may have any desired thickness within the scope of the present disclosure.

In this example embodiment, after forming the blank of material, the blank of material is folded to form the container. When folding the blank of material, an upper portion of the container can be left unfolded and open so that a receptacle can be positioned within the container therethrough. After the receptacle is positioned within the container, the upper portion of the container can be then folded above the receptacle. In this example method, overlapping portions of the folded blank may be coupled together (e.g., glued, etc.) as desired, for example, thereby generally sealing the receptacle in the container.

Also in this example embodiment, the method may further include filling the receptacle (disposed in the container) with desired fluid, and then coupling a seal and a cap to a spout of the receptacle. A security seal may then also be coupled to the upper portion of the container generally over the access opening. Less production steps may be involved for ultimately filling the receptacle in this example embodiment.

Figure 32:
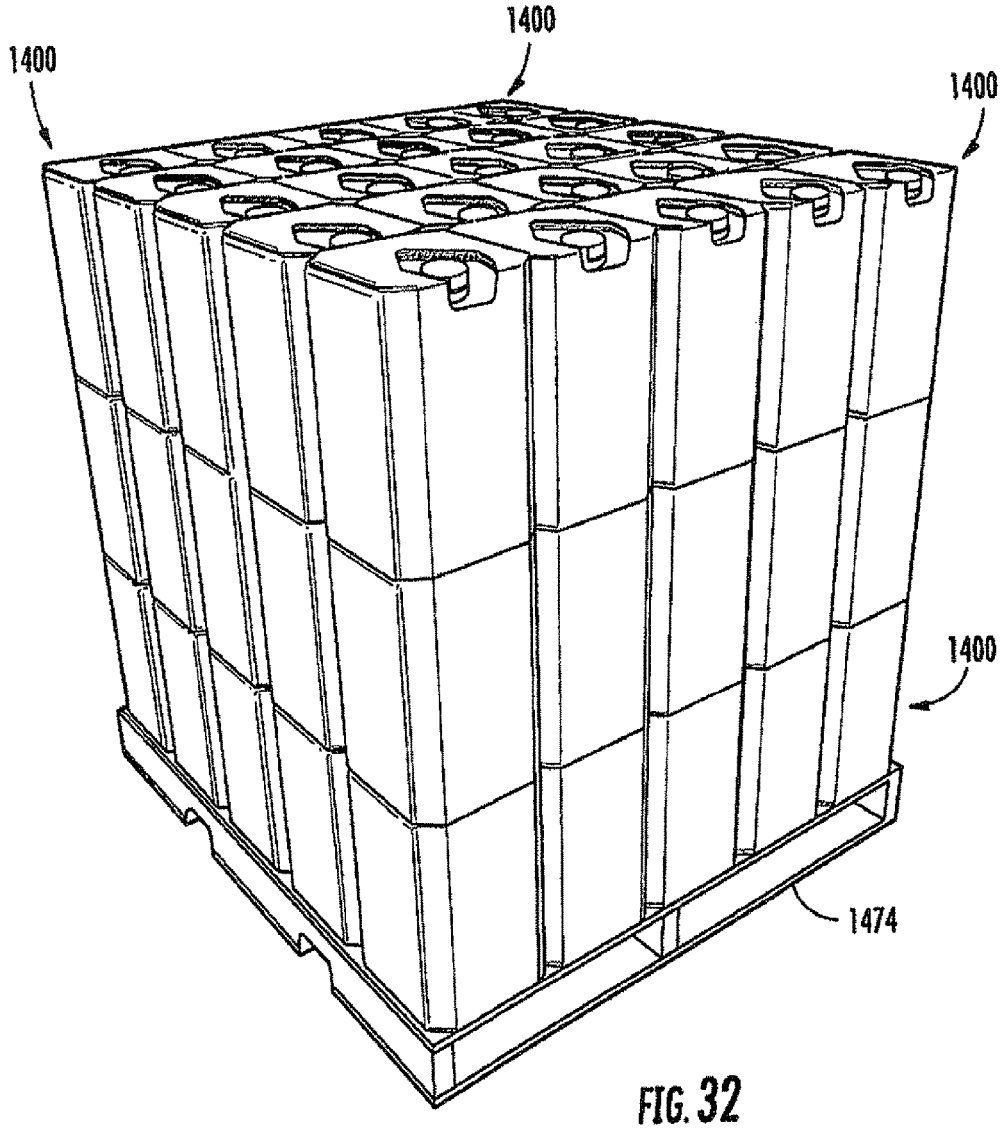
FIG. 32 is a perspective view of multiple example container assemblies stacked on a pallet for shipping, storing, etc.

FIG. 32 illustrates prepared container assemblies 1400 stored with other prepared container assemblies 1400 on a pallet for subsequent shipping, distribution, use, etc. For example, 75 container assemblies 1400 are shown on the pallet.

Figure 33:
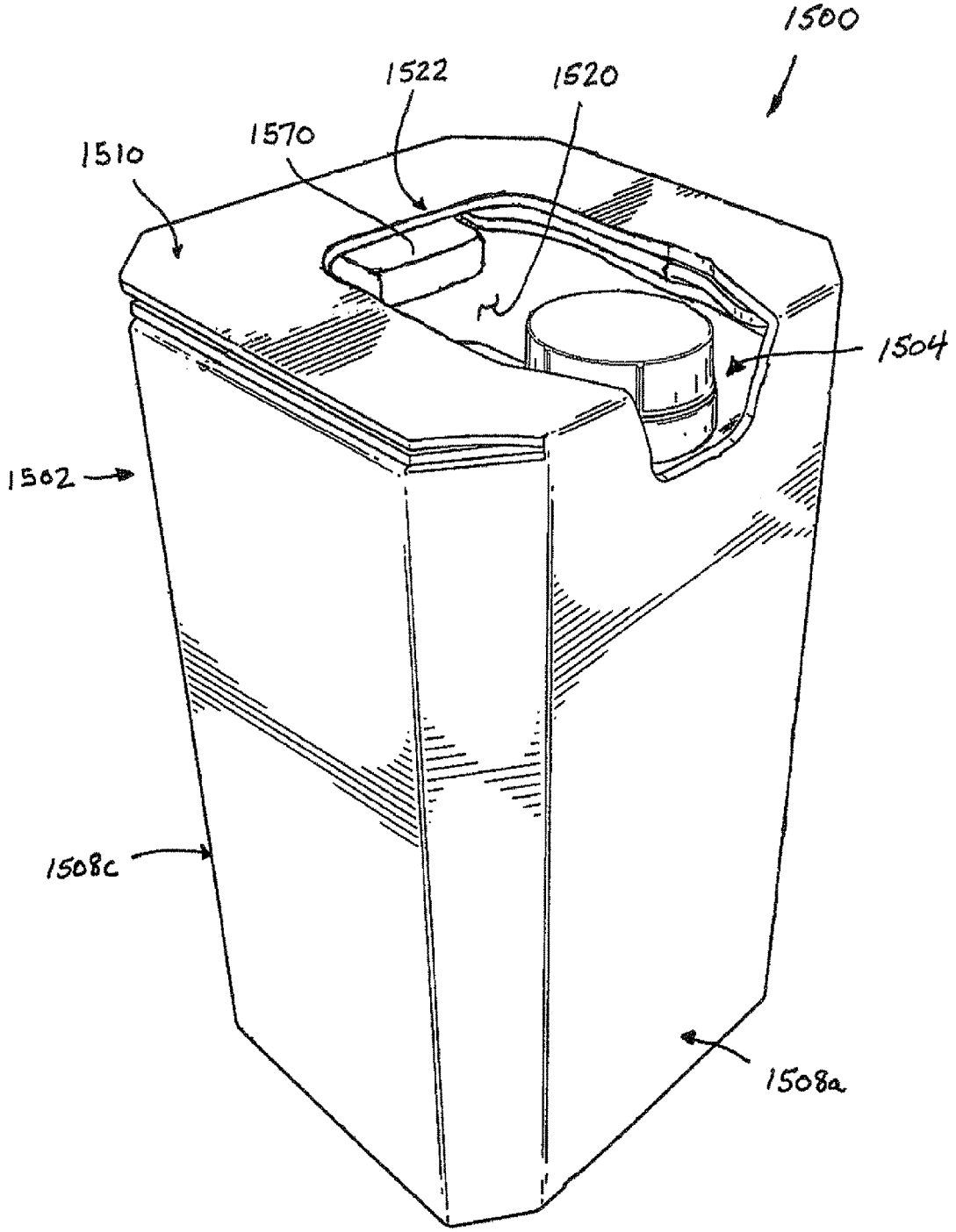
FIG. 33 is a perspective view of a container assembly according to another example embodiment of the present disclosure.
Figure 34:
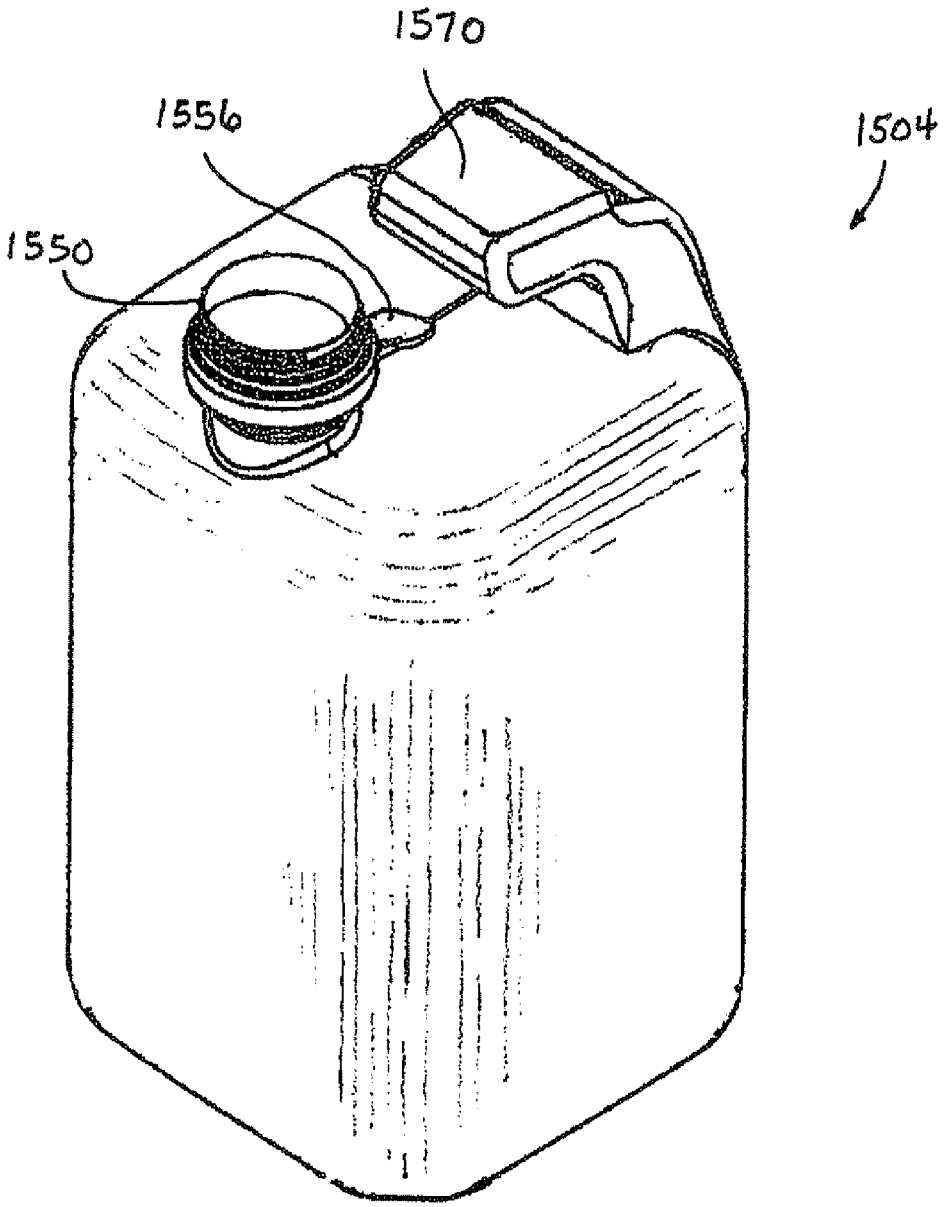
FIG. 34 is a perspective view of a receptacle of the container assembly of FIG. 33.
Figure 35:
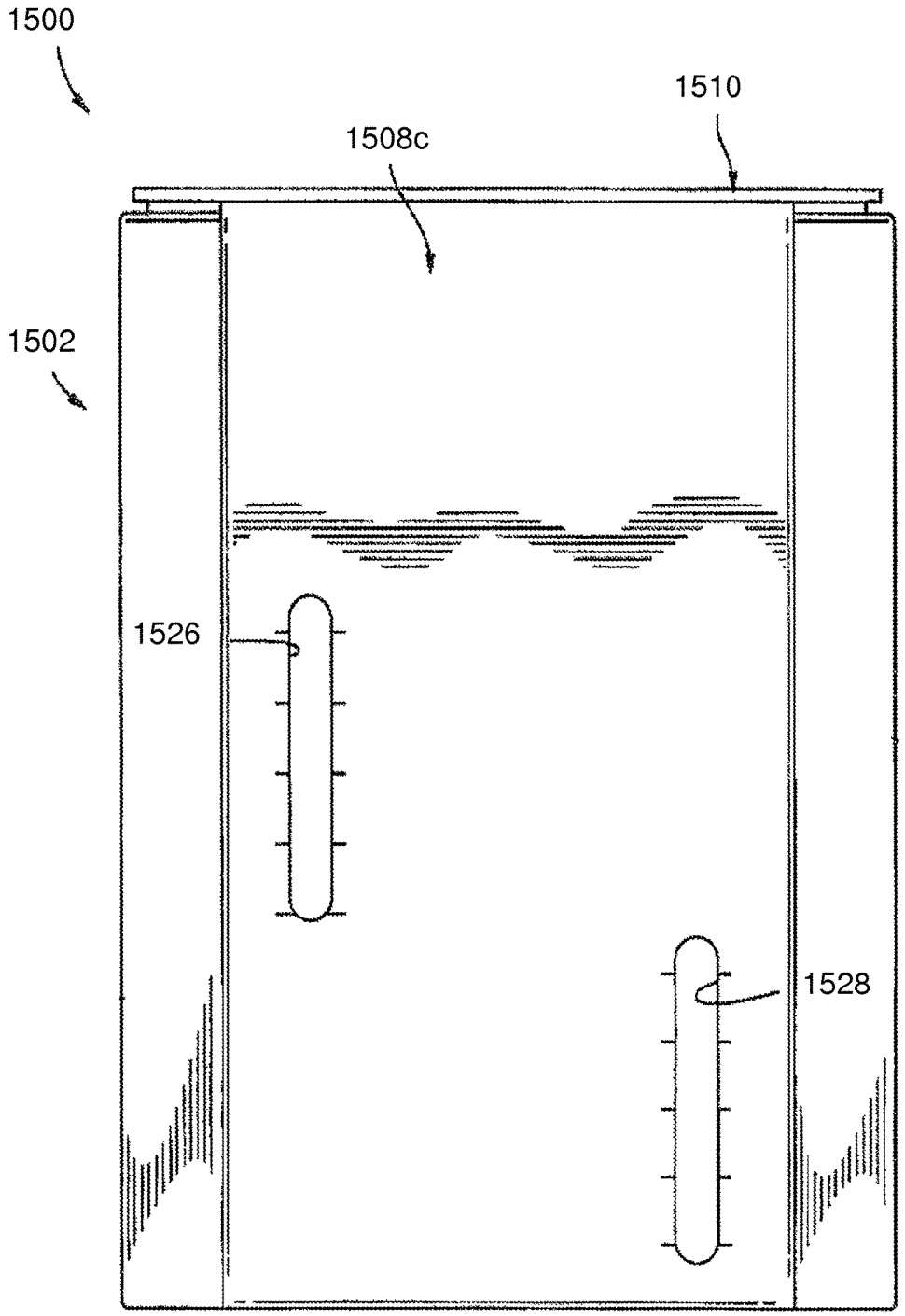
FIG. 35 is a rear elevation view of the container assembly of FIG. 33.

FIGS. 33-35 illustrate a container assembly 1500 according to another example embodiment of the present disclosure. The container assembly 1500 of this embodiment is similar to the container assembly 100 previously described and illustrated in FIGS. 1-19. For example, the container assembly 1500 includes a container 1502 and a receptacle 1504 configured to fit within the container 1502. An access opening 1520 is defined in an upper portion 1510 of the container 1502 as well as in a forward side portion 1508*a* of the container 1502. As such, fluid can be poured from the receptacle 1504 at any desired angle without interference from the container 1502. In addition, the receptacle 1504 includes a vent structure 1556 to help with pouring fluid from the receptacle 1504 (e.g., to provide a generally uniform, smooth, continuous flow of fluid from the receptacle 1504 (e.g., a "no-glug" flow of fluid, a generally steady stream of fluid flow, etc.), etc.), and a spout 1550 that helps inhibit liquid from running down the receptacle 1504 during, after, etc. pouring.

In this embodiment, window openings 1526 and 1528 are defined in a rearward side portion 1508*c* of the container 1502 (as compared to the forward side portion 1508*a* of the container 1502). As such, in this embodiment users may easily view the window openings while gripping the container assembly 1500 and pouring fluid from the receptacle 1504.

Also in this embodiment, the receptacle 1504 includes a flange-style handle 1570 for use in grasping and carrying the receptacle 1504, and for use in helping pour fluid from the receptacle 1504. For example, a user can grasp the container 1502 at a gripping portion 1522 (e.g., an ergonomic gripping portion, etc.) while, at the same time, also grasping the handle 1570 of the receptacle 1504 thereby allowing the user to lift the container 1502 and the receptacle 1504 together (when the receptacle 1504 is disposed within the container 1502), move the container 1502 and the receptacle 1504 together, and/or manipulate the container 1502 to directionally pour fluid from the receptacle 1504. Allowing for gripping the receptacle 1504 and the container 1502 together (by gripping the handle 1570 of the receptacle and the gripping portion 1522 of the container 1502 together at the same time) during use of the container assembly 1500 can provide additional support, stability, etc. to the container assembly 1500. The handle 1570 is also configured to position adjacent the upper portion 1510 of the container 1502 when the receptacle 1504 is disposed within the container 1502 (FIG. 33). In this position, the handle 1570 may engage the upper portion 1510 of the container 1502 when, for example, the container assembly 1500 is manipulated to pour fluid from the receptacle 1504. As such, the handle 1570 can help support the receptacle 1504 within the container 1502 generally against the upper portion 1510 of the container 1502 to help inhibit undesired sliding movement of the receptacle 1504 that could affect, inhibit, etc. fluid pouring operation.

Example container assemblies of the present disclosure generally provide environmentally sensitive (e.g., eco-friendly, etc.) products for storing, shipping, and/or dispensing fluids. Container assemblies of the present disclosure can be recycled as part of the Ag Container Recycling Council (ACRC) steam. For example, after the container assemblies are used (e.g., after pouring fluid from receptacles of the container assemblies, etc.) the receptacles can be removed from containers of the container assemblies, rinsed, and recycled. And, the containers can be broken down and disposed as desired (e.g., recycled, etc.). In addition, the receptacles of the example container assemblies may be formed using less plastic. For example, light weight plastic can be used to form the receptacles because of the additional structural support provided to the container assemblies by the containers. As such, upwards of about fifty percent less plastic may be used to form the receptacles, less chemically exposed plastic (by weight) may be presented for recycling, and weight of the container assemblies may be reduced by up to, for example, about thirty-five percent or more. Further, because the receptacles are substantially sealed within the containers for use, labeling may not be required for the receptacles within the containers (thereby reducing unnecessary paper consumption).

Example container assemblies of the present disclosure may enhance storage and shipping efficiency. For example, the container assemblies are initially prepared for use (e.g., for filling with fluid, etc.) as unitary structures—empty receptacles are positioned within containers of the container assemblies prior to filing the receptacles with fluid. Thus, the prepared (but empty) container assemblies require less storage space because the receptacles are already disposed within the containers. In addition, the octagonal shape of the containers of the container assemblies provide for compact, efficient stacking of the container assemblies (either filled with fluid or empty), for example, on pallets, thereby requiring less storage area for the container assemblies and providing efficient use of available storage space.

Specific dimensions and/or values disclosed herein are exemplary in nature and do not limit the scope of the present disclosure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container assembly for storing, shipping, and/or dispensing fluid, the container assembly comprising:

a container; and a receptacle configured to be disposed within the container, the receptacle having a spout protruding from a top surface of the receptacle and defining an opening for receiving fluid into the receptacle and/or for dispensing fluid from the receptacle;

wherein the container includes an opening defined at least partly in a top portion of the container such that the spout of the receptacle is aligned with the opening of the container when the receptacle is disposed within the container, to thereby facilitate dispensing of fluid from the receptacle through the spout of the receptacle and through the opening of the container; and wherein the receptacle includes a handle defining a flange having a free end portion, the flange disposed generally above the top surface of the receptacle and extending in a direction toward the spout, the free end portion of the flange spaced apart from the top surface of the receptacle and spaced apart from the spout, and the free end portion of the flange having a continuous forward edge portion generally facing the spout to allow a user to grasp the handle at the free end portion of the flange, the handle configured to engage the top portion of the container, when the receptacle is disposed within the container, to help support the receptacle in the container, and the continuous forward edge portion of the free end portion of the flange configured to generally align with the opening of the container, when the receptacle is disposed within the container, such that the flange is accessible through the opening of the container to allow for carrying, by the handle, the receptacle and the container together and to facilitate dispensing fluid from the receptacle when the receptacle is disposed within the container.

2. The container assembly of claim 1, wherein the container includes at least one window opening for viewing fluid level in the receptacle when the receptacle is disposed within the container.

3. The container assembly of claim 2, wherein the at least one window opening includes first and second window openings defined in a rearward side portion of the container.

4. The container assembly of claim 1, wherein the forward edge portion of the flange of the handle generally aligns with an edge portion of the opening of the container generally facing the spout of the receptacle.

* * * * *